US005793875A

United States Patent [19]

Lehr et al.

[11] Patent Number: 5,793,875

[45] Date of Patent: Aug. 11, 1998

[54] DIRECTIONAL HEARING SYSTEM

[75] Inventors: Michael A. Lehr, Palo Alto; Bernard Widrow, Stanford, both of Calif.

[73] Assignee: Cardinal Sound Labs, Inc., Stanford, Calif.

[21] Appl. No.: 635,550

[22] Filed: Apr. 22, 1996

[51] Int. Cl.[6] ..... H04R 25/00

[52] U.S. Cl. ..... 381/68.1; 381/92

[58] Field of Search ..... 381/684, 92

[56] References Cited

U.S. PATENT DOCUMENTS

| | | | |
|---|---|---|---|
| Re. 27,487 | 9/1972 | Hassler | 179/107 |
| 3,665,121 | 5/1972 | Weiss | 179/107 |
| 3,836,732 | 9/1974 | Johanson | 179/107 |
| 3,876,843 | 4/1975 | Moen | 179/107 |
| 3,909,556 | 9/1975 | Johanson | 179/107 |
| 3,946,168 | 3/1976 | Preves | 179/107 |
| 3,975,599 | 8/1976 | Johanson | 179/107 |
| 3,983,336 | 9/1976 | Malek | 179/107 |
| 3,985,977 | 10/1976 | Beaty | 179/107 |
| 4,041,251 | 8/1977 | Gerardus | 179/107 |
| 4,070,553 | 1/1978 | Hass | 179/157 |
| 4,142,072 | 2/1979 | Berland | 179/107 |
| 4,536,887 | 8/1985 | Kaneda et al. | 381/92 |
| 4,741,038 | 4/1988 | Elko et al. | 381/92 |
| 4,751,738 | 6/1988 | Widrow | 381/68.1 |
| 5,289,544 | 2/1994 | Franklin | 381/68.1 |
| 5,425,104 | 6/1995 | Shennib | 381/68.3 |
| 5,463,694 | 10/1995 | Bradely et al. | 381/92 |
| 5,511,128 | 4/1996 | Lindemann | 381/155 |

FOREIGN PATENT DOCUMENTS

| | | |
|---|---|---|
| 2236968 | 2/1974 | Germany . |
| 2323437 | 11/1974 | Germany . |
| 3243850 | 5/1984 | Germany . |
| 61-56600 | 3/1986 | Japan . |
| 61-94500 | 5/1986 | Japan . |
| WO87/06079 | 10/1987 | WIPO . |

OTHER PUBLICATIONS

Sydow, Carsten, Broadband beamforming for a microphone array, *The Journal of the Acoustical Society of America*, No. 2, Aug. 1994, pp. 845–849.

Cao, Yuchang, et al., Speech Enhancement Using Microphone Array with Multi-Stage Processing, *IEICE Trans. Fundamentals*, vol. E79–A., No. 3, Mar. 1996, pp. 386–394.

*Primary Examiner*—Forester W. Isen

*Attorney, Agent, or Firm*—Flehr Hohbach Test Albritton & Herbert LLP

[57] ABSTRACT

A directional acoustic receiving system is constructed in the form of a necklace including an array of two or more microphones mounted on a housing supported on the chest of a user by a conducting loop encircling the user's neck. Signal processing electronics contained in the same housing receives and combines the microphone signals in such a manner as to provide an amplified output signal which emphasizes sounds of interest arriving in a direction forward of the user. The amplified output signal drives the supporting conducting loop to produce a representative magnetic field. An electroacoustic transducer including a magnetic field pickup coil for receiving the magnetic field is mounted in or on the user's ear and generates an acoustic signal representative of the sounds of interest.

The microphone output signals are weighted (scaled) and combined to achieve desired spatial directivity responses. The weighting coefficients are determined by an optimization process. By bandpass filtering the weighted microphone signals with a set of filters covering the audio frequency range and summing the filtered signals, a receiving microphone array with a small aperture size is caused to have a directivity pattern that is essentially uniform over frequency in two or three dimensions. This method enables the design of highly-directive hearing instruments which are comfortable, inconspicuous, and convenient to use. The invention provides the user with a dramatic improvement in speech perception over existing hearing aid designs, particularly in the presence of background noise and reverberation.

39 Claims, 16 Drawing Sheets cardioid: 500 Hz, 5 elements, 3.25 cm cardioid: 1000 Hz, 5 elements, 3.25 cm cardioid: 2000 Hz, 5 elements, 3.25 cm cardioid: 4000 Hz, 5 elements, 3.25 cm

DIRECTIONAL HEARING SYSTEM

FIELD OF THE INVENTION

This invention relates generally to hearing aids, and more particularly to directional microphone arrays used in conjunction with hearing aids which respond to sound in the forward direction of the wearer and minimize the effect of sound coming from above and below and from the sides and the rear.

BACKGROUND OF THE INVENTION

Hearing aid wearers have great difficulty understanding speech in the presence of noise or reverberation. While conventional hearing aids amplify the desired speech signal, they also amplify noise and echoes. In many circumstances, the hearing aid wearer's inability to decipher speech is caused by the poor signal to noise ratio of the signal transmitted by the device, rather than by inadequate amplification. Directional hearing systems can overcome this difficulty by emphasizing the desired speech signal while attenuating surrounding noise and reverberation. When wearing an array designed in accord with the present invention, hearing impaired people have experienced 12–20 dB improvements in signal-to-noise ratio, and even those with severe impairments have often been able to recognize speech in noisy places more accurately than normally hearing people.

Directional devices have been proposed in the prior art. One such device uses moving rotatable conduits which can be turned in the direction which the listener wishes to emphasize (see for example U.S. Pat. No. 3,983,336). Alternatively, efforts have also been made in using movable plates and grills to change the acoustic resistance and thus the directive effect of a directional hearing aid (see U.S. Pat. No. 3,876,843 Moen). None of these efforts have proved to be satisfactory. Old fashioned ear trumpets had been effective in providing amplification and directionality, but they went out of favor with the advent of electronic hearing aids. A microphone array invented by Widrow and Brearley (U.S. Pat. No. 4,751,738) has useful directional properties. The present invention discloses the design of other microphone arrays and describes how they can be built to be worn on the body for maximum convenience and acoustic effect, and how the received signals can be delivered to the ear.

A unique combination of microphone array, signal processing electronics, and a neck loop fashioned as a necklace is proposed. The microphones are mounted on a housing containing the electronics, a battery, and the controls. The housing is supported by the neck loop. The array output signal is applied to an electrical current amplifier that drives the neck loop. This creates a magnetic field that is received by the hearing aid which applies a corresponding sound pressure wave to the ear. The wearer positions his or her body so that the speech signal of interest arrives in a direction perpendicular to the receiving array.

OBJECTS AND SUMMARY OF THE INVENTION

It is an object of this invention to provide array designs that integrate well with comfortable means for mounting the microphones and the associated electronics on the person, while providing a convenient wireless means for delivering the microphone signals to the ear.

It is another object of the invention to provide a unique array geometry and signal processing methodology that yields sharp directivity in two or three dimensions. The directivity is uniform over a wide range of frequencies (e.g., 200 Hz-6 KHz), and the signal processing circuits can be easily configured to allow flexible control of frequency response to fit the hearing requirements of the wearer.

This invention provides a directional hearing system having two or more microphones mounted on a housing supported on the chest of a user by a neck loop. A signal processing unit mounted in the housing receives signals from the microphones and processes the signals to provide an output signal which emphasizes sound from a direction of interest. The output signal is transmitted to an electroacoustic transducer mounted at the ear of the user where it is converted to sound waves, permitting the user to hear sound from the direction of interest.

BRIEF DESCRIPTION OF THE DRAWINGS

The foregoing and other objects of the invention will be more clearly understood from the following detailed description when read in conjunction with the accompanying drawings, wherein.

Figure 12:
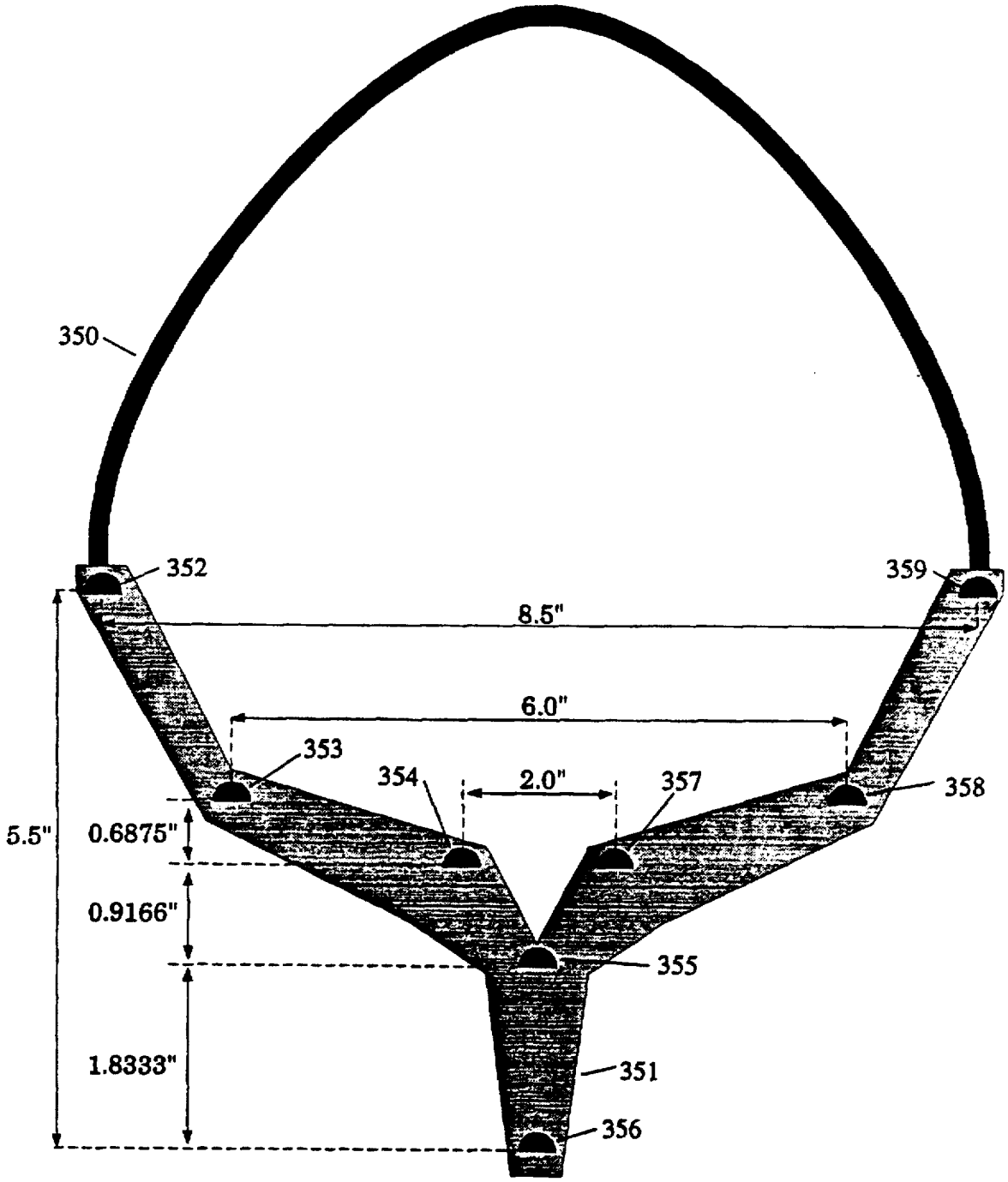
Figure 13A:
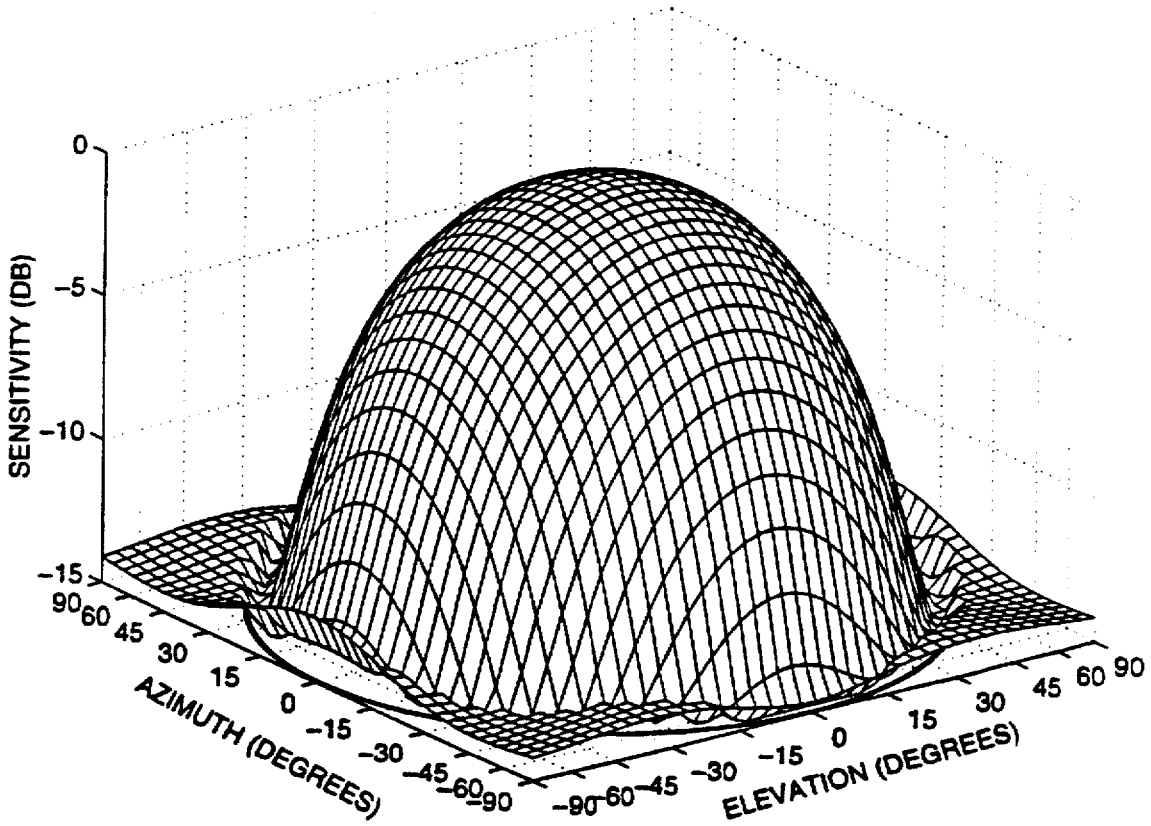

The system is highly directional in both azimuth and elevation;

FIG. 12 shows the geometry of an 8-microphone Lehr-Widrow planar array;

FIGS. 13A–13E show directivity patterns for the example 8-microphone Lehr-Widrow planar array. FIG. 13A shows the 3-dimensional pattern for the frequency range 209–277 Hz.

Figure 14:
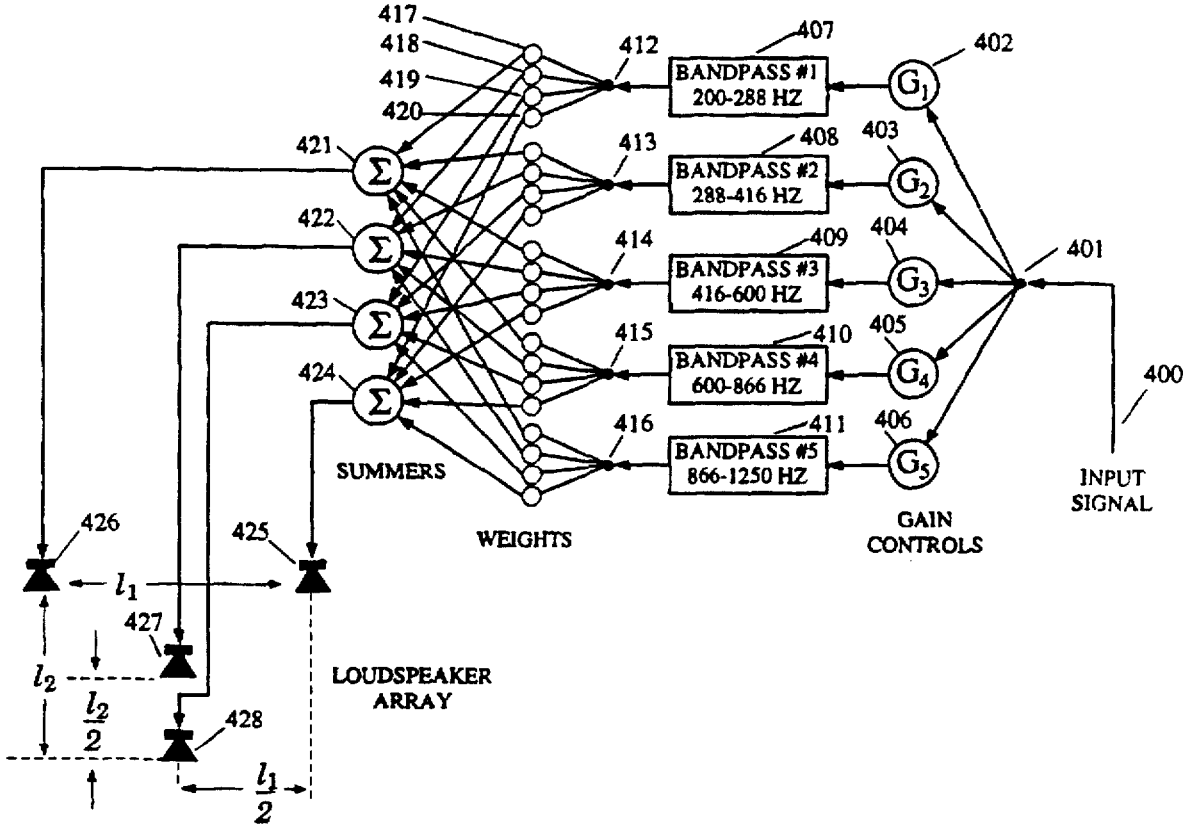

FIGS. 13B–13E show contour plots of the directivity patterns for several frequency bands of the array;

FIG. 14 shows a wide-bandwidth acoustic transmitting array system based on the Lehr-Widrow approach. The system is highly directional in both azimuth and elevation.

DESCRIPTION OF PREFERRED EMBODIMENT

Figure 1:
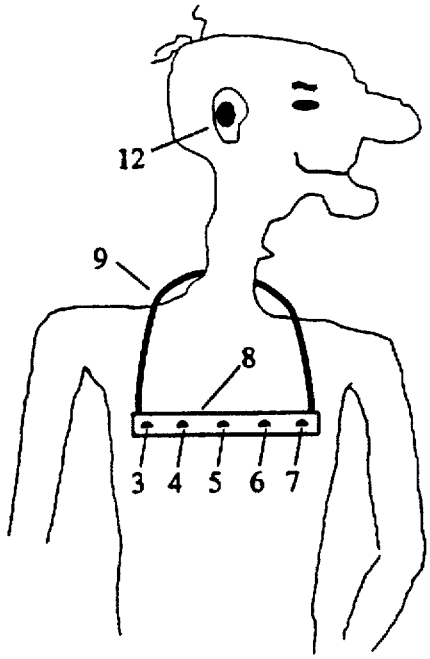
FIG. 1 shows a directional hearing system in accordance with the invention worn by a person.

Referring to FIG. 1, a 5-microphone array 3–7 is mounted on a housing 8 which encloses the associated signal processing electronics and battery. The microphones in FIG. 1 are mounted along a horizontal line. The neck loop 9 serves to support the housing 8 from the wearer's neck. The neck loop is electrically conductive, and generates a magnetic field in response to electrical signals received from the signal processing electronics. The magnetic field induces a signal in the receiving coil of an electroacoustic transducer such as a hearing aid. The array signal is thereby transmitted clearly to the wearer by wireless magnetic coupling. The neck loop 9 and housing 8 can be comfortably worn in an unobtrusive manner under a shirt or sweater. Alternately, it can be made as a piece of jewelry, such as an attractive necklace worn on the chest outside of the clothing.

In the signal processing electronics, the signals from the microphones 3–7 are added together and then amplified to produce an output signal applied to the neck loop. The result is a directional receiving array whose beam width narrows as the frequency rises. The microphones could be uniformly or nonuniformly spaced. The spacing has an effect on the shape of the directivity pattern and how it varies with frequency.

Figure 2:
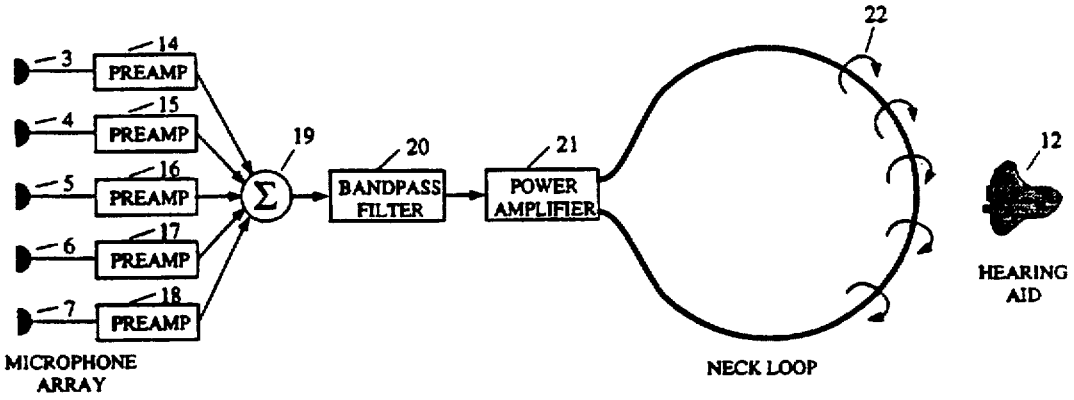
FIG. 2 shows a directional hearing system for transmitting signals from a microphone array to a hearing aid.
Figure 3A:
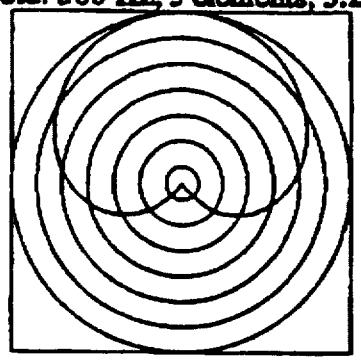
FIGS. 3A–3D show the directivity patterns for a 5-microphone simple additive array at four different frequencies.
Figure 3B:
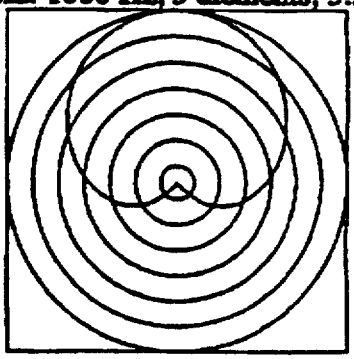
Figure 3C:
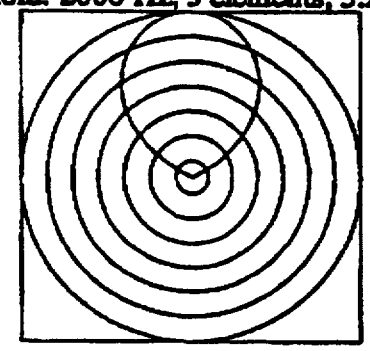
Figure 3D:
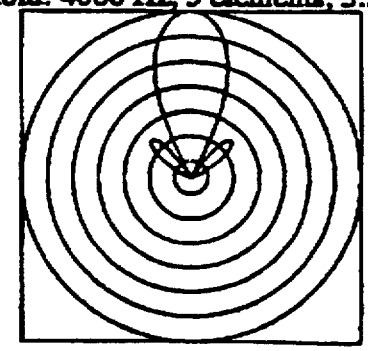

FIG. 2 shows the array of of microphones 3–7, and signal processing electronics. The signals from the microphones are amplified by pre-amplifiers 14–18 housed in the same housing as the microphones. The pre-amplifiers are built into the same housing as the microphones. The amplified signals are summed by summer 19, generally an operational amplifier. The resulting array output signal is usually band-pass filtered 20 to limit the signal to the audio band (approx. 200 Hz-6 kHz) and further amplified by amplifier 21 to raise the power level. The output signal (current) of the power amplifier can be used to drive neck loop 9 to generate magnetic flux 22, which is coupled to the hearing aid 12 by means of its internal telecoil. The output could have been used to drive some other form of telemetry to send the signal from the chest mounted array to the hearing aid. Other forms of telemetry could be radio-frequency electromagnetic radiation, infrared electromagnetic radiation, ultrasonic acoustic radiation, electric currents in the body, or a direct wire connection to the hearing aid. Alternatively, the array output signal could have been used to drive headphones.

In a preferred embodiment, the housing contains the microphone array, batteries and signal processing and amplifying electronics. There are no exterior wires except the neck loop, which is comfortable and convenient to wear as a necklace. It couples the signal magnetically to the conventional hearing aid to provide a signal to the user, obviating the need for a wire connection. This requires no modification to the standard hearing aid.

Placing the microphone array on the chest has advantages over placing the microphone on spectacle frames or placing the microphone in a conventional hearing aid. On the chest, the microphone array is situated far from the hearing aid's loudspeaker (called a receiver). Acoustic coupling and feedback are greatly reduced, enabling the signal level into the ear to be substantially raised, if desired, without causing oscillation. Using this system, people with profound hearing loss are able to distinguish spoken words in noisy environments and in rooms with bad multipath and reverberation. Reverberant signals reflected from the walls of a room cause confusion because they arrive at the ear from different angles and at different times. The directional nature of the array and processor reduce surrounding interference and reduce reverberations. To engage in a conversation or to hear sound from some other desired source, the wearer simply turns his or her body toward the direction of interest, for example, the person speaking. Many people who do not wear hearing aids have great difficulty understanding speech in noisy and/or reverberant places. These people would benefit from listening through a chest-mounted directional system, such as the simple additive array. They could listen with headphones or "ear buds" connected to the array output.

When using the array, the resulting signal would preferably be used to drive a neck loop to provide magnetic coupling to a conventional hearing aid through its telecoil. The neckloop could be a multiturn coil of insulated wire, or it could be a single turn driven by a transformer. If the user wears hearing aids in both ears, both hearing aids could be equipped with telecoils so that the array signal could be received by both hearing aids.

FIGS. 3A–3D show directivity patterns for a simple 5-microphone additive array. The distance between the microphones is 3.25 cm. The circular rings are spaced 3 dB apart. Plots are shown for 500 Hz, 1000 Hz, 2000 Hz, and 4000 Hz. Notice that the beam pattern narrows as the frequency increases and becomes quite sharp at high frequency. With the simple additive array, the element spacings could be made nonuniform. Useful results are obtained, but they generally exhibit larger sidelobes and wider beam widths. Uniform spacing typically gives the best performance.

The simple additive array has the advantage of being implemented with very little signal processing hardware. It has the disadvantage of having a directivity pattern whose sharpness varies with frequency. A beam width of 60° is a good compromise between low noise on the one hand and noncritical body positioning on the other. At low audio frequencies, the beam width of the simple additive array is considerably wider than 60°, and at high audio frequencies, the beam width is considerably less than 60°. A more useful array system would provide a constant 60° beam width at all frequencies.

Figure 4:
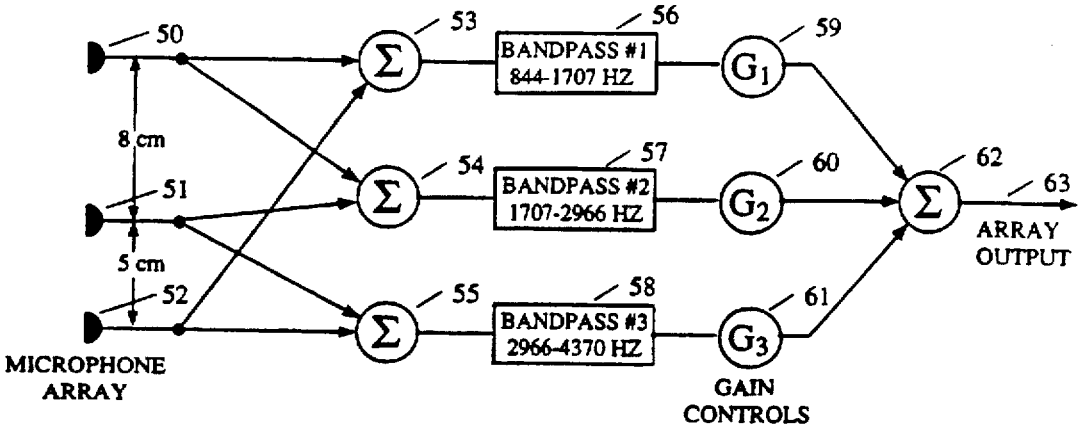
FIG. 4 shows a three-microphone Widrow-Brearley line array with adjustable gains in each of three frequency bands.

The array processor shown in FIG. 4, could be substituted for the simple additive array. A pair of microphones are spaced apart by a distance equal to one-half wavelength of the center frequency of a range of frequencies to be emphasized. By summing the outputs of the two microphones, sounds in the broadside or look direction (the direction perpendicular to the line between the microphones) are emphasized; sounds in the end fire or side directions are nulled or produce a substantially null response in the region of the center frequency defined by the microphone spacing. A third microphone may be added that is not equally spaced from the microphones on either side, but is spaced to provide half wavelength distances which define maximum and null responses centered at the other points within the frequency range desirable for effective hearing. The summed signal from each microphone pair is bandpass filtered. In FIG. 4 three bandpass filters 56, 57, 58 are used. The centers of their pass bands are 1200 Hz, 2250 Hz, and 3600 Hz, respectively. Thus each microphone pair and associated bandpass filter is responsible for providing a directional receiving capability in its assigned range of frequencies. The frequency ranges are contiguous and overlap slightly. The final output 63 is obtained by summing and amplifying the bandpass filter outputs. Each bandpass filter is designed so that its center frequency is:

$$\text{Center Frequency} = \frac{\text{Speed of Sound}}{2 \times \text{Microphone Separation}}$$

With this array processor, separate gain controls could be applied to different portions of the spectrum. Separate automatic gain controls (AGC) could also be applied to individual frequency bands. With three microphones, the processor separates the sound into three independent frequency bands, making it easy to incorporate three independent gain controls, 59, 60, and 61, shown in FIG. 4. With more microphones, there would be more separate frequency bands whose gains could be controlled. Shaping the frequency response is important for users whose natural response is nonuniform. A patient with low auditory sensitivity at high frequencies, for instance, usually requires higher system gain at these frequencies. Other types of arrays would require band-pass filtering to separate the frequencies into bands before independent gain controls would be possible. This array requires much more signal processing hardware, but it provides a directivity pattern with an approximately 60° beam width over the audio range. Although the simple additive array is workable, this array works better but is expensive to implement.

The microphones of both arrays are mounted along a horizontal straight line. These directional arrays are selective in azimuth only. In accordance with one feature of the present invention, arrays are provided that are not only selective in azimuth, but are simultaneously selective in elevation. Their beam patterns are highly selective in three-dimensional space and they provide clear signal reception within the directional window of their 3-D beams, with greatly reduced noise.

Figure 5:
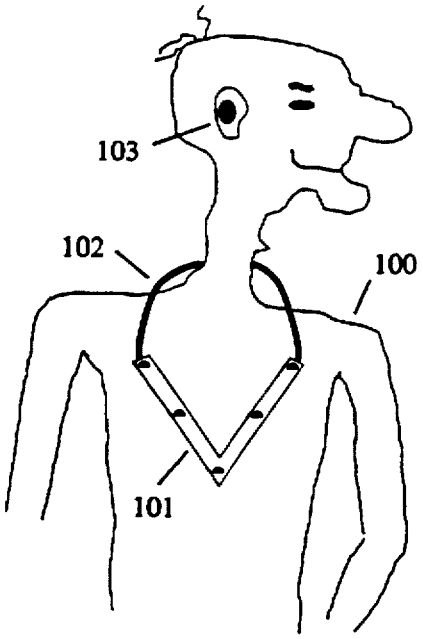
FIG. 5 shows the basic form of a planar V-shaped 5-microphone simple additive array which is comfortable and directive in 3 dimensions.

FIG. 5 shows a person 100 wearing a planar array. Five microphones are mounted on a V-shaped structure 101 that houses the battery and the electronics, and it is supported by the neck loop 102. Once again, the amplified array output signal drives the neck loop to create a magnetic field for wireless signal transmission to the telecoil-equipped hearing aid 103. The microphone signals are added together to produce the array output signal which is amplified to drive the neck loop.

Figure 6A:
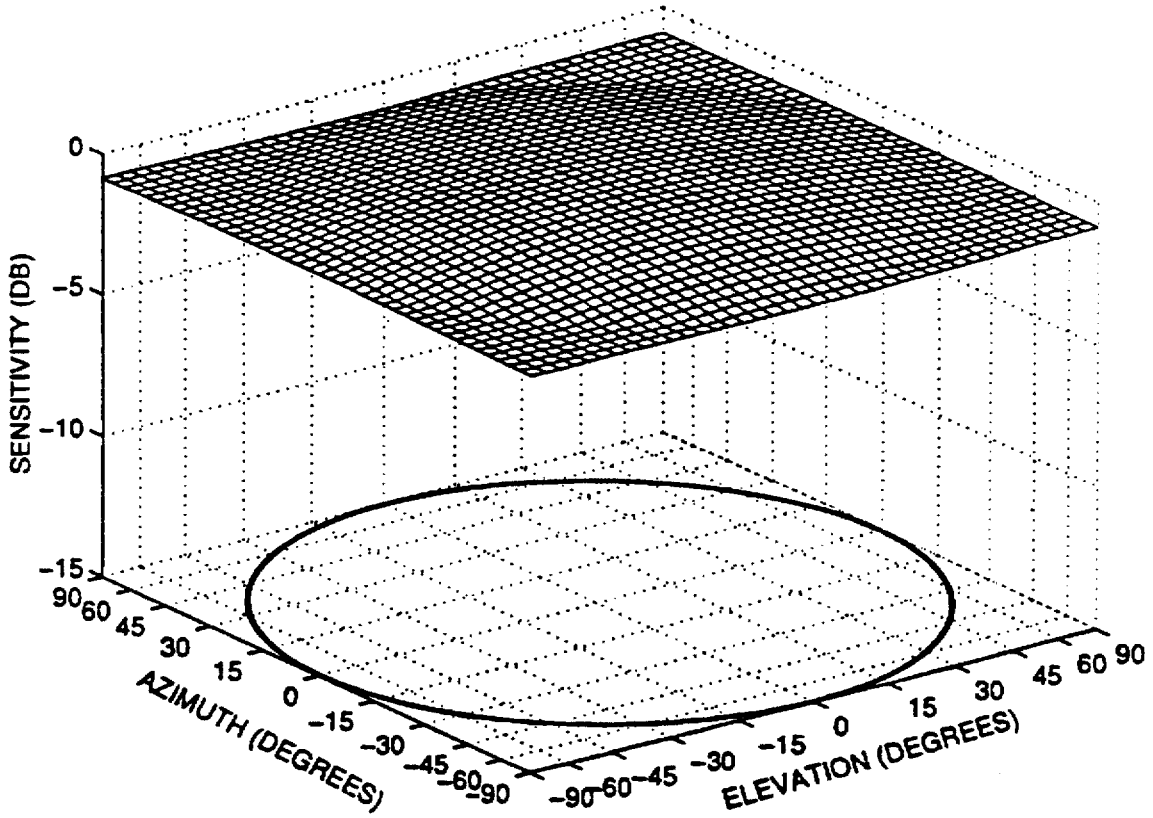
FIGS. 6A–6C show the three-dimensional directivity patterns of the planar V-shaped 5-microphone simple additive array at frequencies of 300 Hz, 1000 Hz, and 5500 Hz, respectively.
Figure 6B:
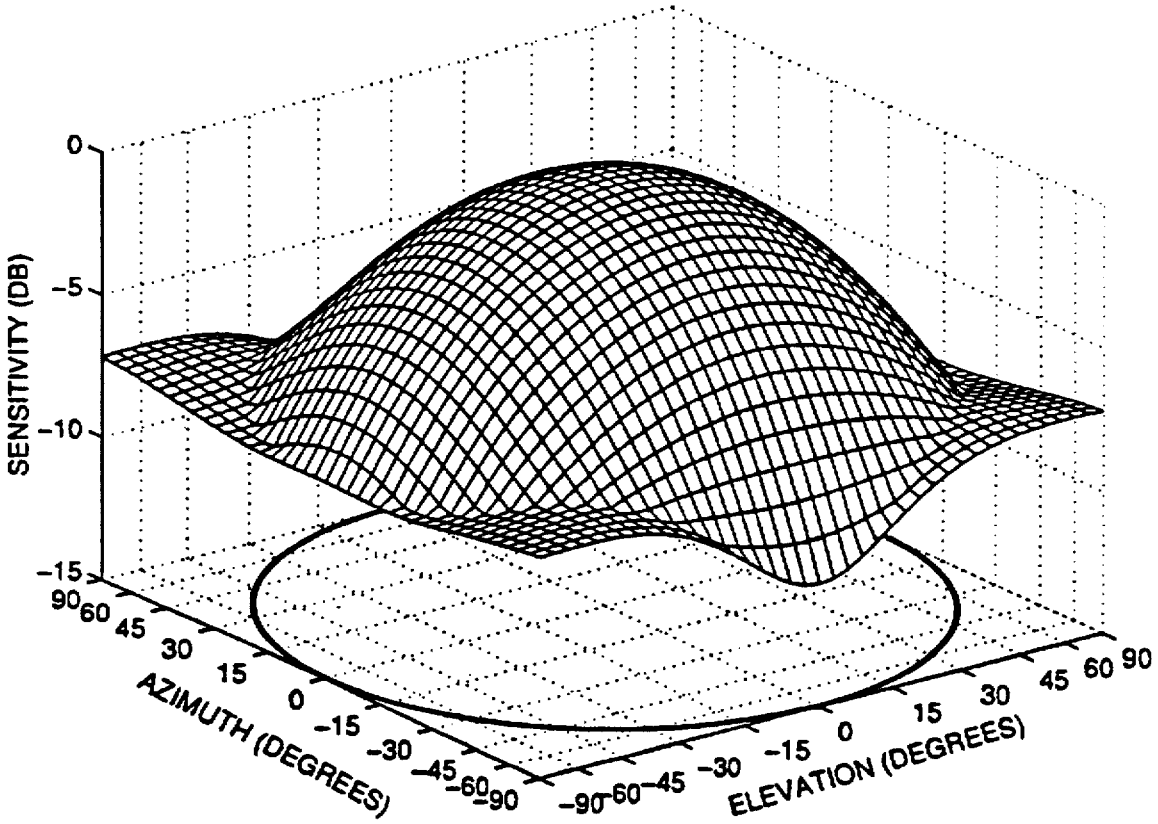
Figure 6C:
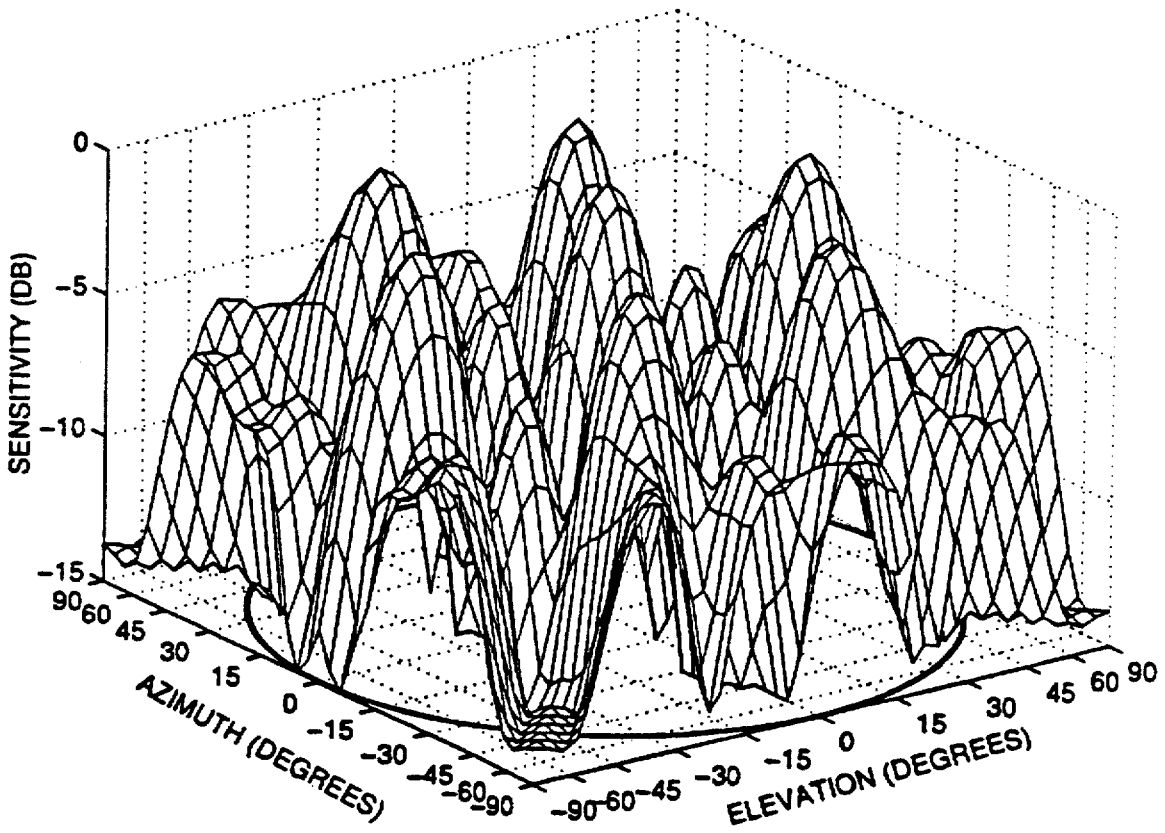

The V-shaped array could be arranged in many different ways. Many angles for the V would be possible, as well as many spacings for the microphones would be possible. Suppose, for example, that the V-shaped housing 101 of FIG. 5 consists of two sides of an equilateral triangle, that each side is 6 inches long, and that the microphones are equally spaced. This array will be selective in both azimuth and elevation. The directivity pattern in a direction normal to the plane of the array is plotted for a frequency of 300 Hz in FIG. 6A. FIGS. 6B and 6C show the directivity patterns at frequencies of 1000 and 5500 Hz, respectively. Although the array produces good directivity at 1000 Hz, it produces very poor directivity patterns at 300 Hz and 5500 Hz. At 300 Hz, the directivity is too weak to be useful. At 5500 Hz, the pattern contains large sidelobes, and the main lobe is so narrow that it would be difficult for the wearer to aim the beam. At the cost of greater circuit complexity, much better performance can be achieved with the Lehr-Widrow planar array, described below. Sharp directivity patterns that are essentially invariant with frequency can be realized with this array.

Figure 7:
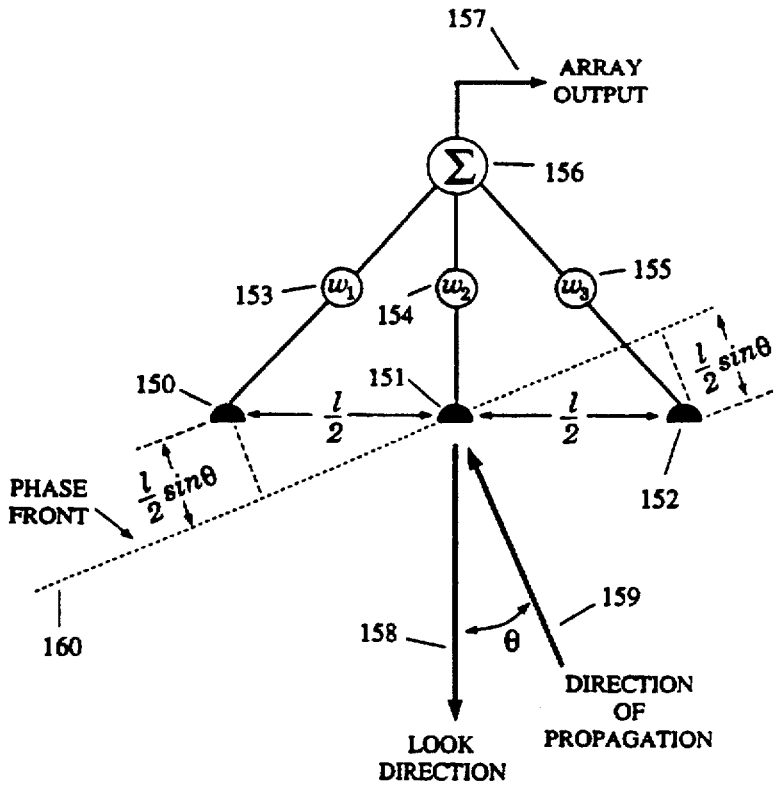
FIG. 7 shows the geometry of a 3-microphone Lehr-Widrow line array.

An understanding of the Lehr-Widrow planar array can be gained by first examining a three microphone array mounted along a horizontal straight line, as shown in FIG. 7. The three microphones 150, 151, 152, are equally spaced, and this array will be directive only in azimuth, indicated by angle θ. The microphone outputs are weighted, i.e. multiplied by the coefficients 153, 154, 155, and are then added by the summer 156 to form the array output signal 157. The outer weights 153, 155 are made equal, so that the response will be symmetrical for positive and negative directions of arrival, i.e. for +θ and −θ. Referring to FIG. 7, the look direction 158 (the direction of maximum response) is indicated to be perpendicular to the line of the microphone array. Assume that sound is arriving at the array in the direction of propagation 159. A phase front 160 is shown perpendicular to the direction of propagation. Uniform phase exists in the sound field along line 160. Assume that the sound field is sinusoidal. Using phaser notation, let the output signal of the center microphone 151 be exp (jωt). The output signal of microphone 152 is phase advanced from this by πl(sin θ)/(λ) radians, where λ is the wavelength of the sound. The output signal of microphone 152 is therefore given by exp (jωt+jπl(sin θ)/λ). The output signal of microphone 150 is phase retarded, and its output signal is exp (jωt−jπl(sin θ)/λ). The array output signal 157 is the sum of the three microphone signals. Referring to FIG. 7, the array output is $$\begin{aligned} y(t) &= w_2 e^{j\omega t} + w_1 e^{j\omega t + j\frac{\pi l \sin\theta}{\lambda}} + w_1 e^{j\omega t - j\frac{\pi l \sin\theta}{\lambda}} \\ &= e^{j\omega t}\left[ w_2 + w_1\left( e^{j\frac{\pi l \sin\theta}{\lambda}} + e^{-j\frac{\pi l \sin\theta}{\lambda}} \right)\right] \\ &= e^{j\omega t}\left[ w_2 + 2w_1\cos\left(\frac{\pi l \sin\theta}{\lambda}\right)\right]. \end{aligned} \tag{1}$$

The amplitude of the array output as a function of angle θ is therefore $$|y(t)| = w_2 + 2w_1\cos\left(\frac{\pi l \sin\theta}{\lambda}\right). \tag{2}$$

The weights can be constrained so that if the direction of propagation is θ=0, the amplitude of the array output will be 1. Accordingly, $$\omega_2 + 2\omega_1 = 1. \tag{3}$$

The weights can also be chosen so that the amplitude of the array output will be 0 if the direction of propagation is θ=±90 °. Accordingly, $$w_2 + 2w_1\cos\left(\frac{\pi l}{\lambda}\right) = 0. \tag{4}$$

Meeting these conditions makes the array directional. Maximum output results from signals arriving in the look direction. Zero output results from signals arriving at right angles to the look direction. To make this work, one must set the weights to satisfy the simultaneous linear equations $$\begin{cases} w_2 + 2w_1 = 1.0 \\ w_2 + 2w_1\cos\left(\frac{\pi l}{\lambda}\right) = 0. \end{cases} \tag{5}$$

This is the basic idea of the Lehr-Widrow array.

If the width of the array l is for example chosen to be one tenth of a wavelength, the weights will be chosen in accord with Equations (5) to be $$\omega_1 = 10.215 \tag{6}$$

$$\omega_2 = -19.43.$$

Under these conditions, the amplitude of the array output will be $$w_2 + 2w_1\cos\left(\frac{\pi l \sin\theta}{\lambda}\right) = -19.43 + 20.43\cos\left(\frac{\pi \sin\theta}{10}\right). \tag{7}$$

Figure 8:
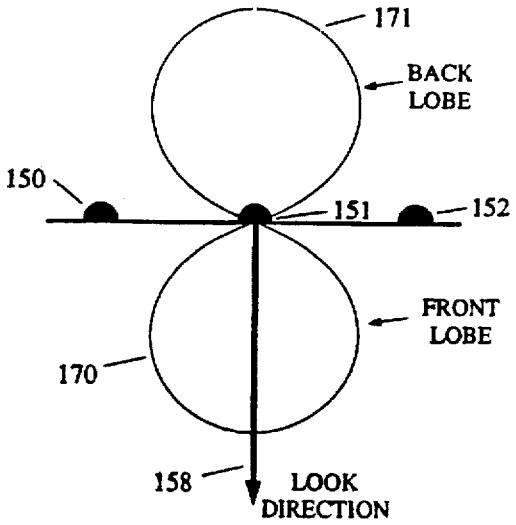
FIG. 8 shows the directivity pattern of the 3-microphone Lehr-Widrow line array at the center of its frequency band.

This function is illustrated with a polar plot in FIG. 8. This is the directivity pattern of the array. The array's three microphones are shown in this figure. The look direction 158 is indicated. When worn on the chest, only the front lobe of the array is operational. The back lobe is eliminated by baffling. The body of the wearer casts an acoustic shadow that essentially eliminates sound reception from the rear.

It is interesting to compare the Lehr-Widrow line array with the array described in the Widrow-Brearley patent. Widrow-Brearley uses two microphones mounted along a horizontal line, spaced one half wavelength apart. The microphone signals are simply added, so their weights are equal to 1. Lehr-Widrow uses three microphones mounted along a horizontal line. They can be spaced much closer than one half wavelength, as the above example illustrates. Their weights are typically not equal to 1. The Lehr-Widrow array can be adapted to a different wavelength by leaving the geometry fixed and adjusting the weights.

There are two distinct advantages to the Lehr-Widrow approach:

(1) The array can be much smaller than a half wavelength. At a frequency of 200 Hz, for example, a half wavelength is about 2.5 feet. This microphone spacing would be much too great for a chest mounted microphone array. Widrow-Brearley would not work at this important frequency, but Lehr-Widrow would. With an array width equal to one tenth of a wavelength, the array would be practical and would be about six inches long.

(2) The same array geometry could be used for different wavelengths simply by making proper choices of the weight values $\omega_1$ and $\omega_2$ in accord with Equations (5). Since the same set of three microphones can be used in several frequency bands of a multi-band system, the Lehr-Widrow array will usually require fewer microphones than the Widrow-Brearley array when the number of bands is large.

Note from Equations (6) that the weighting $\omega_1$ of the outer two microphones is positive and that the weighting $\omega_2$ of the inner microphone is negative. The reversal in sign between the central weight and the outer two weights is a basic characteristic of the Lehr-Widrow array which makes it possible to achieve high directivities when the width of the array is much smaller than a half-wavelength in the frequency band of interest. As the frequency is increased, the negative weighting of the central microphone decreases. At higher frequencies, both the central microphone and outer microphones are typically positively weighted.

Two factors limit the range of wavelengths over which the basic Lehr-Widrow approach discussed above is successful. At long wavelengths (corresponding to sound at low frequencies), the microphone weightings become large and the array becomes increasingly sensitive to variations in the gains of individual microphones. With relatively inexpensive commercially-produced microphones, full directivity can be obtained from the Lehr-Widrow approach at wavelengths as large as 10 times the width of the array, which is 5 times the maximum wavelength that provides full directivity from a Widrow-Brearley array of the same physical dimensions. Thus the width of a practical Lehr-Widrow line array can be one-fifth that of a practical Widrow-Brearley array, for the same range of operating frequencies. Partial directivity is available from the Lehr-Widrow array at wavelengths longer than 10 times the width of the array. Although the approach theoretically works for sound up to arbitrarily long wavelengths, mismatched gain values in physical microphones limits the microphone weightings that can be used in a practical device.

The second factor that limits the range of wavelengths that can be used with the above approach is the emergence of sidelobes in the directivity patterns at short wavelengths. This behavior was observed for the simple uniform V-shaped array in FIG. 6C. The above Lehr-Widrow approach continues to work well at wavelengths as small as 7/10 of the width of the array. Undesirable sidelobes appear in the directivity patterns at wavelengths smaller than this.

Two different methodologies can be used to design successful uniform beam width Lehr-Widrow arrays for wavelengths shorter than this. The simplest approach is to add one or more additional pairs of microphones to the array on either side of the central microphone. This creates additional sets of three microphones that have closer spacings than the original set. In a short wavelength (high frequency) band, the weights can then be designed by the same approach used above.

The second method for obtaining uniform beam width line arrays at short wavelengths involves using more than three microphones in each band. If 1, 2, 3, or more additional microphones were placed between microphones of the three-microphone array, and all microphone outputs were simply added together, sharp beam widths which vary with frequency would be obtained. The beams could be dulled and the frequency dependency could be removed by using mismatched microphone weightings. These weightings would be different in each high-frequency band. The weight values for this variation of the Lehr-Widrow array are most easily determined by using optimization methods that will be described below.

Figure 9:
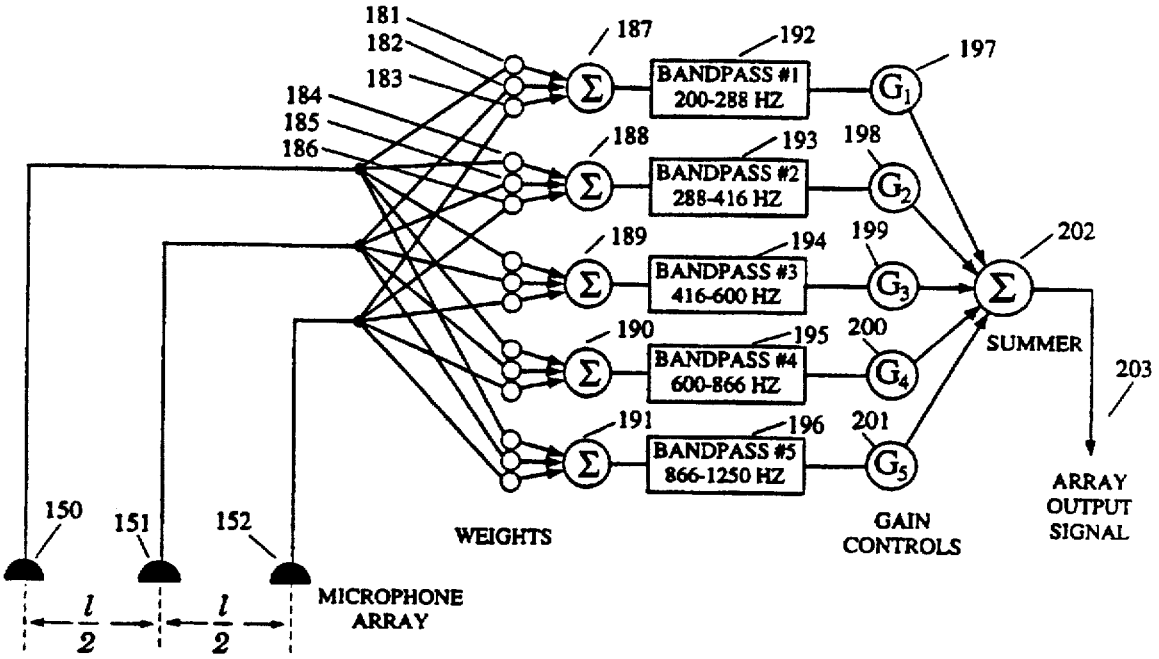
FIG. 9 shows a wide-bandwidth directional receiving system based on a 3-microphone Lehr-Widrow line array.

A simple wide-bandwidth directional receiving system based on a 3-microphone Lehr-Widrow array is shown in FIG. 9. This system breaks the spectrum into 5 bands, 200–288 Hz, 288–416 Hz, 416–600 Hz, 600–866 Hz, and 866–1250 Hz. A practical system could include a second smaller three-element Lehr-Widrow array for a set of high-frequency bands between 1250 Hz and about 6 or 8 kHz.

The center frequency of each band (at the geometric mean of the band limits) is 240 Hz, 346 Hz, 500 Hz, 721 Hz, and 1040 Hz respectively. At these frequencies, the wavelengths in inches are 56.20", 38.95" 27.00", 18.71", 12.97", respectively. Making the width of the array equal to one tenth of a wavelength for the lowest frequency band (the band with the longest wavelength), the width l will be 5.62 inches. This is a comfortable, practical, array width.

Once the array width is chosen, five sets of weights for the microphones are determined for each of the five wavelengths. Equations (5) are used for this. The signals for band one (wavelength of 56.20") come from microphones 150, 151, and 152, weighted respectively by weights 181, 182, and 183. Weights 181 and 183 have equal values for reasons of symmetry, as discussed above. The weighted signals are added by summer 187, and then fed to the 200–288 Hz band-pass filter 192. The purpose of the band-pass filter is to allow only signals whose wavelengths are close to the design wavelength for the chosen weights to pass through. The signals for band two (wavelength of 38.95") come from the same microphones 150, 151, and 152, and are weighted by weights 184, 185, and 186, then summed by 188 and applied to band-pass filter 193 for the 288–416 band. The signals for bands three, four, and five are processed by the same approach used for bands one and two. Each band-pass filter outputs the signal components in its band. The total array output signal 203 is the sum of the band-passed signals, further weighted by the gains 197, 198, 199, 200, and 201, then added by summer 202. The gains allow control of the frequency response of the entire system.

As described above, FIG. 9 shows a Lehr-Widrow directional receiving system that covers the frequency range from 200–1250 Hz. This system breaks the spectrum into five bands to accomplish this. It is clear that better control of the directivity pattern could be achieved if the spectrum were broken into a greater number of bands. More bands require more circuitry, but keep the frequencies at the extremes of each band closer to the geometric mean frequency for which the weights of that band were designed. If more bands were used, the circuit would be an obvious extension of the circuit of FIG. 9. Equations (5) would be solved to determine the weight values.

The advantages of the Lehr-Widrow line array can be extended to apply to a planar array of microphones which would be directive in both azimuth and elevation. An array that is small in its physical dimensions can be made to produce sharp directivity patterns in three dimensions.

Figure 10:
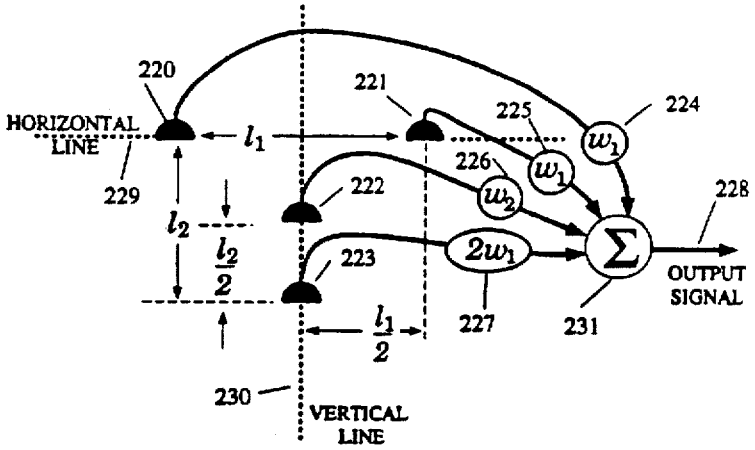
FIG. 10 shows the simplest form of the 3-D Lehr-Widrow beamformer using a planar array of microphones.

The simplest 3-D Lehr-Widrow beamformer is based on the planar array of microphones shown in FIG. 10. Microphones 220 and 221 are mounted along the horizontal line 229. Microphones 222 and 223 are mounted along the vertical line 230. This line cuts the horizontal line half way between microphones 220 and 221. The spacing between microphones 220 and 221 is $l_1$. The spacing between microphones 222 and 223 is $l_2/2$. The spacing between microphone 222 and the horizontal line 229 is $l_2/2$. The array is mounted on a support structure, flat against the chest. The look direction, the direction of maximum sensitivity, is perpendicular to the plane of the array.

The microphone output signals are weighted by the coefficients 224, 225, 226, and 227, then added by the summer 231 to provide the output signal 228. The weight 224 has the value $\omega_1$. Symmetry along the horizontal line requires the weight 225 to also have the value $\omega_1$. Symmetry along the vertical line requires the weight 223 to have the value $2\omega_1$, equal to the sum of the values of the weights 220 and 221. The weight 216 has the value $\omega_2$. The weight values $\omega_1$ and $\omega_2$ are to be chosen so that maximum sensitivity is to be achieved for sound arriving in the look direction, and zero sensitivity is to be obtained for sound arriving in the vertical and horizontal directions perpendicular to the look direction.

Sound coming from the look direction arrives simultaneously at all four microphones and causes their output signals to be equal. The array output signal will be the sum of the weighted microphone signals, or the sum of the weight values multiplied by the output signal of a single microphone. The array output can be made equal to the single microphone output by making the sum of all the weights equal to one. Thus, $$4\omega_1+\omega_2=1. \tag{8}$$

Since all of the microphone output signals are identical and are in phase at any particular frequency when the sound arrival is in the look direction, maximum output is obtained in this case. To make the array output equal to zero for directions of sound arrival that are perpendicular to the look direction, other requirements must be satisfied by the weight values. Referring to FIG. 10, sound arriving from left or right along the direction of the horizontal line 229 should cause a zero array output signal. Sound arriving from above or below along the direction of the vertical line 230 should also cause a zero array output signal.

The weight values $\omega_1$ and $\omega_2$ can be chosen to achieve these results. Referring to FIG. 10, sound arriving in the horizontal direction from right to left will first encounter microphone 221. Then it will simultaneously encounter microphones 222 and 223, whose weighted outputs when added behave like the output of a single microphone. Then it will encounter microphone 220. The action is analogous to that of the three microphone array of FIG. 7 when sound arrives from the direction $\theta=\pi/2$ and the array output signal is determined by Equation (4). Applying the basic idea of Equation (4) to the array of FIG. 10, this relation becomes $$2w_1 + w_2 + 2w_1\cos\left(\frac{\pi l_1}{\lambda}\right) = 0. \tag{9}$$

Satisfaction of this equation will result in a zero output response to sound arriving from either right to left or left to right.

Once again, applying the basic idea of Equation (4) to the array of FIG. 10, a zero response to sound arriving from above or below along the direction of the vertical line 230 requires the following equation to hold:

$$w_2 + 4w_1\cos\left(\frac{\pi l_2}{\lambda}\right) = 0. \tag{10}$$

For the array of FIG. 10 to have a sensitivity of 1 in the look direction and a sensitivity of zero in all directions perpendicular to the look direction, Equations (8), (9), and (10) must hold simultaneously.

$$\begin{cases} 4w_1 + w_2 & = 1 \\ 2w_1 + w_2 + 2w_1\cos\left(\frac{\pi l_1}{\lambda}\right) & = 0 \\ w_2 + 4w_1\cos\left(\frac{\pi l_2}{\lambda}\right) & = 0. \end{cases} \tag{11}$$

These simultaneous equations are nonlinear and impossible to solve exactly, though iterative numerical solutions can be used to find accurate estimates of the solution. Analytical methods can be used to find approximate solutions, however, when the cosines in Equation (11) are of small angles, as for example when the dimensions $l_1$ and $l_2$ are of the order of a tenth of a wavelength or smaller. These are practical circumstances. Using the first two terms of the Taylor expansion of cosine about 0, one may write $$\cos(A) \approx 1 - \frac{A^2}{2}, \tag{12}$$

which is valid for small angles A expressed in radians. When Equation (12) is valid, Equations (11) can be replaced with $$\begin{cases} 4w_1 + w_2 & = 1 \\ 2w_1 + w_2 + 2w_1\left(1 - \frac{1}{2}\left(\frac{\pi l_1}{\lambda}\right)^2\right) & = 0 \\ w_2 + 4w_1\left(1 - \frac{1}{2}\left(\frac{\pi l_2}{\lambda}\right)^2\right) & = 0. \end{cases} \tag{13}$$

Equations (13) have as unknowns $\omega_1$, $\omega_2$, $l_1$, and $l_2$. There are three equations and four unknowns. If one of the variables is treated as a chosen value, the remaining variables can be solved. If the second and third lines of Equations (13) are combined, the following results:

$$\frac{l_1}{l_2} = \sqrt{2}. \tag{14}$$

If the first and third lines of Equations (13) are combined, the following results:

$$w_1 = \frac{1}{2}\left(\frac{\lambda}{\pi l_2}\right)^2. \tag{15}$$

Combining this with Equation (14) yields $$w_1 = \left(\frac{\lambda}{\pi l_1}\right)^2. \tag{16}$$

Combining this with the first line of Equations (13) yields $$w_2 = 1 - 4\left(\frac{\lambda}{\pi l_1}\right)^2. \tag{17}$$

The key design equations for the array of FIG. 10 are Equations (14), (16), and (17).

Since one of the variables of $\omega_1$, $\omega_2$, $l_1$, and $l_2$ can be chosen, let this be the array width $l_1$. The main consideration in making this choice is that $l_1$ be small enough to comfortably fit the human torso. Once a reasonable value of $l_1$ is selected, the angles $\pi l_1/\lambda$ and $\pi l_2/\lambda$ turn out to be small at the important low frequency portions of the human hearing response. For these frequencies, the approximation (12) is valid. The low frequencies are very important for speech perception by the typical hearing impaired individual.

Once $l_1$ is chosen, Equations (14), (16), and (17) can be used to determine the array height $l_2$ and the weight values $\omega_1$ and $\omega_2$. It is useful to note that when $l_1$ is fixed and $l_2=l_1/\sqrt{2}$ is fixed, changing the wavelength only requires changing $\omega_1$ and $\omega_2$.

The following implication is an important one. The microphone array geometry can be fixed, and the array will work properly for different wavelengths of sound by selecting values of the weights $\omega_1$ and $\omega_2$ in accord with Equations (16) and (17). The same array can be used over a wide range of frequencies if the sound is broken into narrow frequency bands and each band has its own set of four weights determined by the corresponding values of $\omega_1$ and $\omega_2$. After weighting and band-pass filtering, the frequency components are added to reconstitute the signal of interest. The approach works when the small angle approximation (12) is relatively accurate. Outside this range, good results can still be obtained by choosing $l_1$ and letting $l_2=l_1 1/\sqrt{2}$ as before. Inserting $l_1$ and $l_2$ into the first nonlinear set of equations (11), these equations become an overdetermined linear set of three equations with two unknowns. The best least squares solution for the weights is determined by a simple pseudo-inverse as described in elementary texts on linear algebra such as Gilbert Strang, "Linear Algebra and Its Applications," Harcourt, Brace, Jovanovich, third edition, San Diego, 1988.

Like the three-element line array described earlier, a given four element planar array can be used effectively only to wavelengths as small as approximately 7/10 of $l_2$. Undesirable sidelobes appear in the directivity patterns at short wavelengths. To use the concept over a broader range of frequencies, one or more sets of three additional microphones can be added to the array at points surrounding the central microphone to create one or more additional sets of four microphones. At high frequencies, the design of the weights can be carried out in accord with the above approach, only now using one of the more closely-spaced clusters of four microphones.

At these high frequencies, sharper beams which vary with frequency would be obtained by using more than four of the microphones at a time. Uniformly weighted planar arrays using 5, 6,7, or more microphones could be used. Approximately uniform beam widths over frequency may be obtained from arrays containing five or more microphones in each high-frequency band by introducing intentional mismatch in the microphone weightings. The weight values for this form of the Lehr-Widrow planar array are most easily determined by using optimization methods that will be described below.

Figure 11:
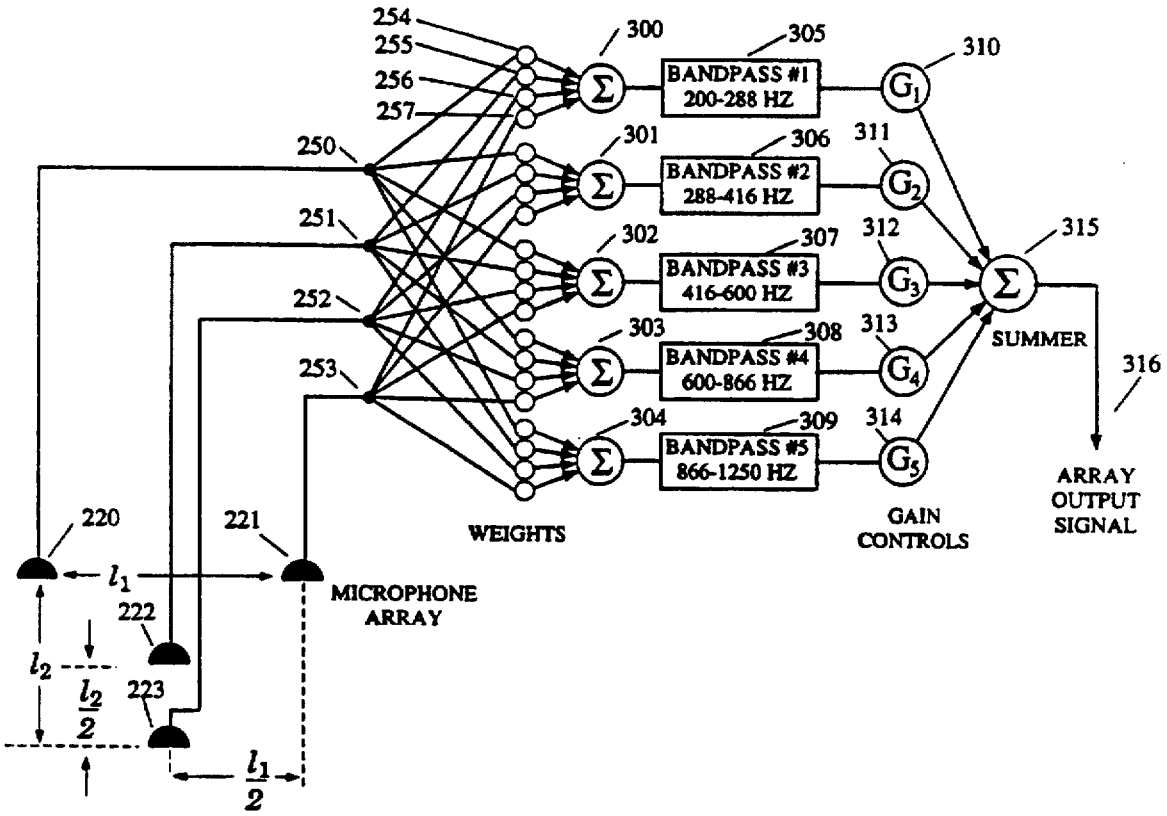
FIG. 11 shows a wide-bandwidth receiving array system based on the Lehr-Widrow approach.

FIG. 11 shows a wide-bandwidth receiving array system for acoustic signals that is directional in both azimuth and elevation. This is like the system of FIG. 9, except that the array geometry is planar rather than straight line. The sound spectrum is broken into five bands, 200–288 Hz, 288–416 Hz, 416–600 Hz, 600–866 Hz, and 866–1250 Hz. A practical system would include a second smaller four-element planar Lehr-Widrow array for a set of high-frequency bands between 1250 Hz and about 6 or 8 kHz.

The geometric center frequencies of the five bands are 240 Hz, 346 Hz, 500 Hz, 721 Hz, and 1040 Hz respectively. At these frequencies, the wavelengths in inches are 56.20", 38.95", 27.00", 18.71", 12.97", respectively. Making the array height equal to one tenth of a wavelength for the lowest frequency band (the band with the longest wavelength), $l_2$ will be 5.62 inches. From Equation (14), the width of the array is then $l_1=5.62\sqrt{2}=7.94$ inches. This is a comfortable, practical size for the array.

Once the array height and width are chosen, a different set of weights for the microphones is determined for each of the five wavelengths. Each set of weights is designed for the geometric mean frequency of the corresponding spectral band. For the lowest-frequency band, four weights 254, 255, 256, and 257 are chosen. They weight microphone signals 250, 251, 252, and 253. The weighted signals are added by summer 300. The sum is applied to the band-pass filter 305, whose output gain is controlled by attenuator 310. For each frequency band, there is a set of microphone weights whose outputs are summed and applied to a band-pass filter. The filter outputs are gain controlled and then summed by summer 315 to provide the array output signal 316. The frequency response of the entire system is determined by the settings of the gains 310, 311, 312, 313, and 314.

To illustrate how the weights are designed, consider band 1, with a wavelength of 56.20 inches. For this band, the angle corresponding to the argument of the cosine function of Equation (11) is $\pi l_1/\lambda$ or about 25° in the horizontal dimension, while the corresponding angle in the vertical dimension is $\pi l_2/\lambda$ or 18°. These angles are small enough for accurate use of the cosine approximation of Equation (12). The weights 254 and 257 have the same value $\omega_1$ given by Equation (16):

$$w_1 = \left(\frac{\lambda}{\pi l_1}\right)^2 = \left(\frac{56.2}{7.94\pi}\right)^2 = 5.076.$$

Weight 256 has the value $2\omega_1$:

$$2\omega_1 = 10.15.$$

Weight 255 has the value $\omega_2$, given by Equation (17)

$$w_2 = 1 - 4\left(\frac{\lambda}{\pi l_1}\right)^2 = 1 - 4(5.076) = -19.30.$$

Note once again that at low frequencies, the central microphone is negatively weighted (here, by weight 255), while the outer microphones are positively weighted (here, by weights 254, 256, and 257). As the frequency of interest is increased, the negative weighting of the central microphone will diminish. At higher frequency bands, all microphones will typically have positive weightings.

In band 2, the small angle approximation is somewhat less accurate, so the values $\omega_1$ and $\omega_2$ may be solved instead using the pseudoinverse.

Applying $\lambda$=38.95", $l_1$=7.94", and $l_2$=5.62", Equations (11) produces a system of three linear equations for band 2:

$$\begin{cases} 4w_1 + w_2 = 1 \\ 3.60w_1 + w_2 = 0 \\ 3.596w_1 + w_2 = 0 \end{cases} \tag{18}$$

Inserting the first equation into the second and third equations yields an equivalent set of three equations:

$$\begin{cases} 4w_1 + w_2 = 1 \\ 0.4w_1 = 1 \\ 0.404w_1 = 1. \end{cases} \tag{19}$$

The first line, which corresponds to the array sensitivity in the look direction, is treated as a constraint, while the other two equations are solved to yield the best least squares solution. This produces:

$$w_1 = \left( [0.4\ 0.404] \begin{bmatrix} 0.4 \\ 0.404 \end{bmatrix} \right)^{-1} [0.4\ 0.404] \begin{bmatrix} 1 \\ 1 \end{bmatrix} = 2.4875. \tag{20}$$

Using this result and the first line of Equations (19), $$\omega_2 = -8.95. \tag{21}$$

The values $\omega_1$ and $\omega_2$ are now used to compute the four weights for band two by the same formulation used in band one. In bands three, four, and five, the values $\omega_1$ and $\omega_2$ are also solved using the pseudoinverse, and the result from each band is used to determine the values of the corresponding 4 weights.

The result after solving all weight values is an acoustic receiving array system whose directivity pattern shows to a good approximation a gain of one in the look direction and a gain of zero perpendicular to the look direction, independent of frequency. Using more band-pass filters, the approximation would be more precise.

The microphones of the Lehr-Widrow planar array can be arranged in many other geometries. For example, a square arrangement of microphones can be formed by reducing the width of the array of FIGS. 10 and 11, $l_1$, to equal the height $l_2$, and then replacing microphone 223 of this array with two microphones at the same vertical position, but with one directly below microphone 221 and one directly below microphone 229. The weightings for the original microphones would remain unchanged, and the weightings for the two new microphones would each be equal to $\omega_1$. In each band, this five-microphone square-shaped Lehr-Widrow array will have the same response to forward sound, and to sound arriving in the vertical or horizontal directions as the corresponding four-microphone V-shaped Lehr-Widrow array system of FIG. 1 1. Other systems that can be solved by the same basic analytical approach used for the weights of FIG. 11 include those with a central microphone surrounded by a set of outer microphones arranged in a circle, a hexagon, an octagon, and other common geometries. The V-shaped arrangement of FIG. 10, however, is particularly well-suited for placement on the chests of both male and female adults and children.

The V-shaped Lehr-Widrow receiving array system design of FIG. 11 uses a minimum number of microphones and allows control of the directivity pattern only in the look direction and at right angles to it along two slices in three dimensional space. The sensitivity in other directions is determined by the geometry of the array. In general, slices at other angles exhibit small sidelobes and good directivity when those in the horizontal and vertical directions have these characteristics. To get further control of the directivity pattern at other angles of incidence, more microphones and more weights would be needed.

If more microphones and more weights are used, the question arises about how to determine the weight values. Suppose, for example, that eight microphones are to be used, and that the directivity pattern is to be controlled at 100 different angles of incidence. This situation would require the satisfaction of 100 simultaneous equations (more, if symmetry conditions are placed on the weight values) analogous to the equations (11). There would be only eight weights and sixteen parameters for determining the positions of the microphones that could be varied (fewer if symmetry conditions are placed on the positions of the microphones). With 100 equations and twenty four unknowns, an exact solution cannot be obtained. One could, however, find a solution that minimizes the sum of the squares of the errors in the equations. This would be a best (nonlinear) least squares solution to making the directivity pattern fit best to a desired directivity pattern.

Consider an N-microphone array receiving an acoustic wave having a wavelength of $\lambda$. The microphones may be in any configuration in 3-dimensional space, and need not be constrained to lie on a plane. The microphone outputs are weighted and summed to create an array output signal that can be expressed in phaser notation as $$y = \sum_{i=1}^{N} w_i e^{j\phi_i} e^{j\omega t}, \tag{22}$$

where $\phi_i$ is the phase shift of the unit magnitude signal arriving at microphone i, and $\omega$ is the frequency of this signal in radians per second. The phase shift can be expressed in radians as:

$$\phi_i = \frac{2\pi \rho_i^T v}{\lambda}, \tag{23}$$

where $\rho_i$ is a three component column vector representing the position of microphone i with respect to the origin of the array in Euclidean 3-dimensional space. The array's origin can be defined as any position in 3-dimensional space that is fixed relative to the position of the array. v is a 3-component unit-length column vector representing the direction of arrival of the sound in the array's coordinate system.

Equation (22) can also be written as $$y = e^{j\omega t} \left( \sum_{i=1}^{N} w_i \cos\phi_i + j \sum_{i=1}^{N} w_i \sin\phi_i \right). \tag{24}$$

The array output power can be expressed as $$P = \left( \sum_{i=1}^{N} w_i \cos\phi_i \right)^2 + \left( \sum_{i=1}^{N} w_i \sin\phi_i \right)^2. \tag{25}$$

Three vectors can be defined as follows:

$$\begin{aligned} C &= [\cos \Phi_1, \ldots, \cos \Phi_N]^T \\ S &= [\sin \Phi_1, \ldots, \sin \Phi_N]^T \\ W &= [\omega_1, \ldots, \omega_N]^T. \end{aligned} \tag{26}$$

The power output can now be expressed in vector notation as $$P = (C^T W)^2 + (S^T W)^2. \tag{27}$$

The power output is a function of the weights and is also a function of the components of the direction of arrival of the sound relative to the look direction, $\theta_A$ being the azimuth angle and $\theta_E$ being the elevation angle. The array output power can be represented by: $P(\theta_A,\theta_E, W)$. The desired array output power is a function of the direction of arrival of the incident sound. This can be represented by: $D(\theta_A,\theta_E)$.

The maximum array output power, the output power when the incident sound is in the look direction, will be constrained to have a unit value. For this direction, $$\Phi_1=\Phi_2=\ldots=\Phi_N, \tag{28}$$

so that $$C=[1\ 1\ \ldots\ 1\ ]^T, \tag{29}$$

and $$S=[0\ 0\ \ldots\ 0]^T, \tag{30}$$

and $$P=([1\ 1\ \ldots\ 1]W)^2=\left(\sum_{i=1}^{N} w_i\right)^2=1. \tag{31}$$

Accordingly, the constraint can be written as $$[1\ 1\ \ldots\ 1]W=\sum_{i=1}^{N} w_i=1. \tag{32}$$

Subject to this constraint, the weights are to be chosen to find the best least squares solution of the following equation:

$$D(\theta_A,\theta_E)-P(\theta_A,\theta_E, W)=0. \tag{33}$$

The solution is sought for all of the angles of incidence for which $D(\theta_A,\theta_E)$ is specified. Simultaneous equations are to be solved for all of the specified angles, subject to Constraint (32).

This formulation applies to both the line array and the planar array. Constraint (32) from the general formulation above corresponds to Constraint (3) from the 3-microphone line array example of FIG. 7. Equation (33) corresponds to Equation (4) from the same example. Likewise, Constraint (32) from the general formulation above corresponds to Constraint (8) for the 4-microphone planar array example of FIG. 10, and Equation (33) corresponds to Equations (9) and (10) from the same example. Constraint (32) and Equation (33) are general, and they apply to the line and planar arrays of any number of microphones in arbitrary positions.

To solve these equations in general, an objective function to be minimized can be defined as follows:

$$\begin{aligned} J(W) &= \underset{\theta_A,\theta_E}{E}\ [\{D(\theta_A,\theta_E)-P(\theta_A,\theta_E,W)\}^2] \\ &= \text{mean square error of array power directivity pattern.} \end{aligned} \tag{34}$$

Of course, other objective functions may be used for the weight optimization. An alternative to Equation (34) could replace $P(\theta_A,\theta_E, W)$, and $D(\theta_A,\theta_E)$ with their respective positive square roots, for instance, or it could replace the squaring operation in Equation (34) with a fourth power. Other functions of $J(W)$, such as $\sqrt{J(W)}$, the root mean square error, could also be minimized.

The optimization is performed over randomly selected angles of incidence for the arriving acoustic wave, and the objective function is an average or expected value over all incident angles. The weights will be chosen to minimize the objective function, with the sensitivity in the look direction constrained to the value 1. The gradient of the objective function is $$\frac{\partial J(W)}{\partial W}=\underset{\theta_A,\theta_E}{E}\left[-2\{D(\theta_A,\theta_E)-P(\theta_A,\theta_E,W)\}\frac{\partial P(\theta_A,\theta_E,W)}{\partial W}\right],$$

where $$\frac{\partial P(\theta_A,\theta_E,W)}{\partial W}=2[CC^T+SS^T]W. \tag{35}$$

As noted above, the constraint for microphones that lie in a plane perpendicular to the look direction is:

$$\sum_{i=1}^{N} w_i=1. \tag{36}$$

This constraint causes an array of unity gain microphones to have unit sensitivity to sources on a line perpendicular to the center of the array, when the distance to the source is large in relation to the dimensions of the array. If the microphones do not lie in a plane, the constraint is obtained from Equation (27) as $$(C^TW)^2+(S^TW)^2=1, \tag{37}$$

where C and S are defined by Equations (26) for a source in the look direction. The constraint is nonlinear unless the microphones lie in a plane.

Standard constrained optimization techniques using Lagrange multipliers with the method of steepest descent were used by computer to find the weights for specific cases. Lagrange multipliers are used to ensure that the first-order necessary conditions for optimality (which ensure that the gradient of the objective function along the constraint surface is zero) are satisfied at the converged solution. The process of steepest descent itself guarantees satisfaction of the second order optimality conditions (which ensure that the second derivatives of the objective function are positive, so that the solution is at a minimum rather than a maximum or a saddle point). The performance surface for some microphone configurations is nonconvex and multimodal, so the solution is guaranteed only to reach a local optimum. In practice, however, the results obtained by methods of this type are excellent. The mathematical methods for constrained minimization of an objective function using steepest descent are widely known and are, for example, described in the classic textbooks: Bryson and Ho, "Applied Optimal Control," Hemisphere Publishing Corporation, 1975, and Luenberger, "Linear and Nonlinear Programming," Addison Wesley, second edition, 1984. Other methods of optimization can also be used to adjust the weights. Methods using random search, genetic algorithms, conjugate gradients, BFGS (Broyden-Fletcher-Goldfarb-Shanno), sequential quadratic programming, etc., are obvious extensions to the approach presented here.

An 8-microphone Lehr-Widrow planar array was designed by using the above methodology and constructed in the form of a necklace for practical use. The locations of the microphones are shown in the scale drawing of FIG. 12. The conductive neckloop 350 and the housing 351 supporting the microphones 352–359 and containing the signal processing electronics are shown in the drawing. The frequency range of the array extended from 209 Hz to 6104 Hz. This range was broken into 12 bands whose frequency ranges were the following: 209–277 Hz, 277–367 Hz, 367–486 Hz, 486–644 Hz, 644–853 Hz, 853–1129 Hz, 1129–1496 Hz, 1496–1982 Hz, 1982–2626 Hz, 2626–3478 Hz, 3478–4608 Hz, 4608–6104 Hz. The desired response function $D(\theta_A,\theta_E)$ used to optimize the weights comprised a cone centered in the look direction with a value of unity at angles within 30° of the look direction, and a value of zero at angles outside this range.

Figure 13B:
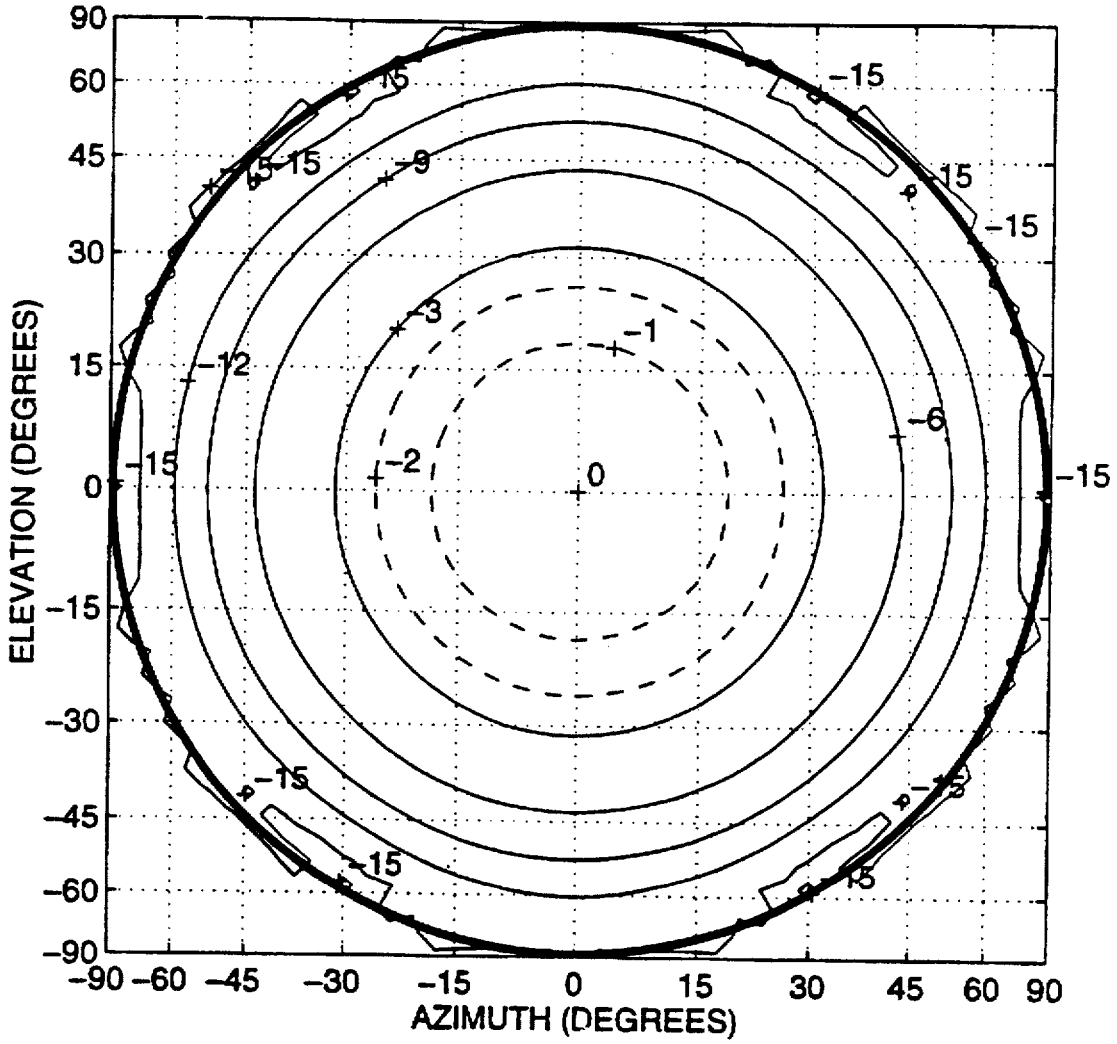
Figure 13C:
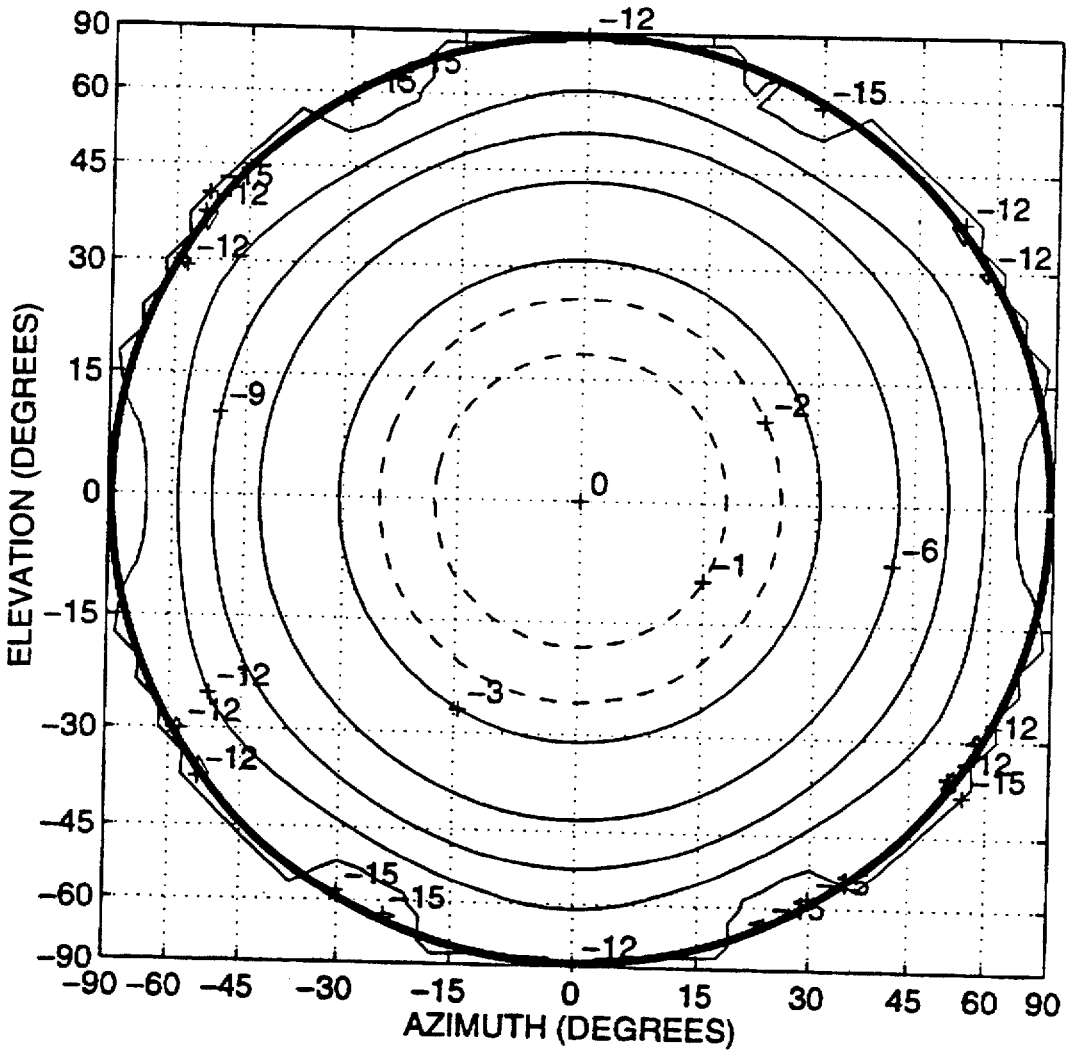
Figure 13D:
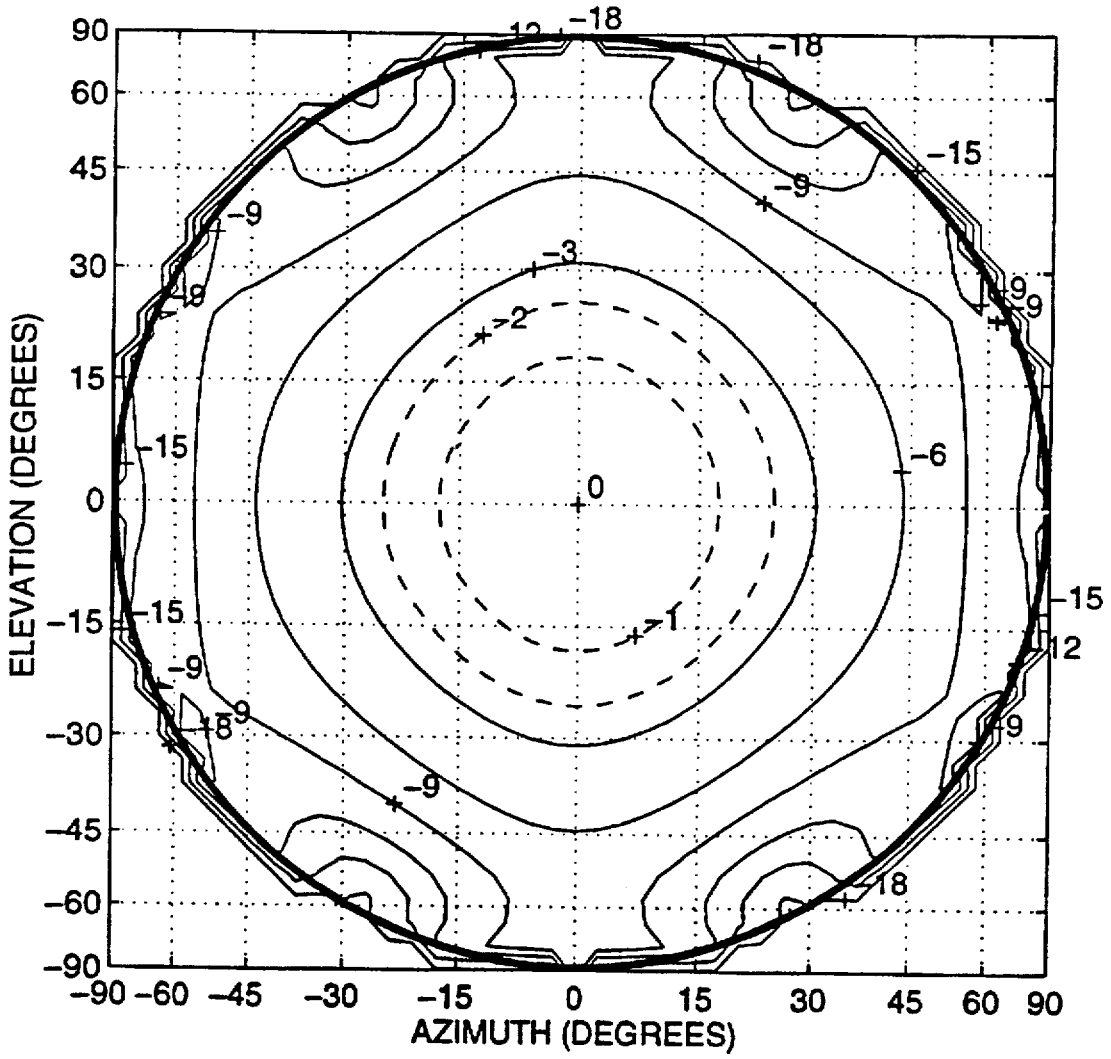
Figure 13E:
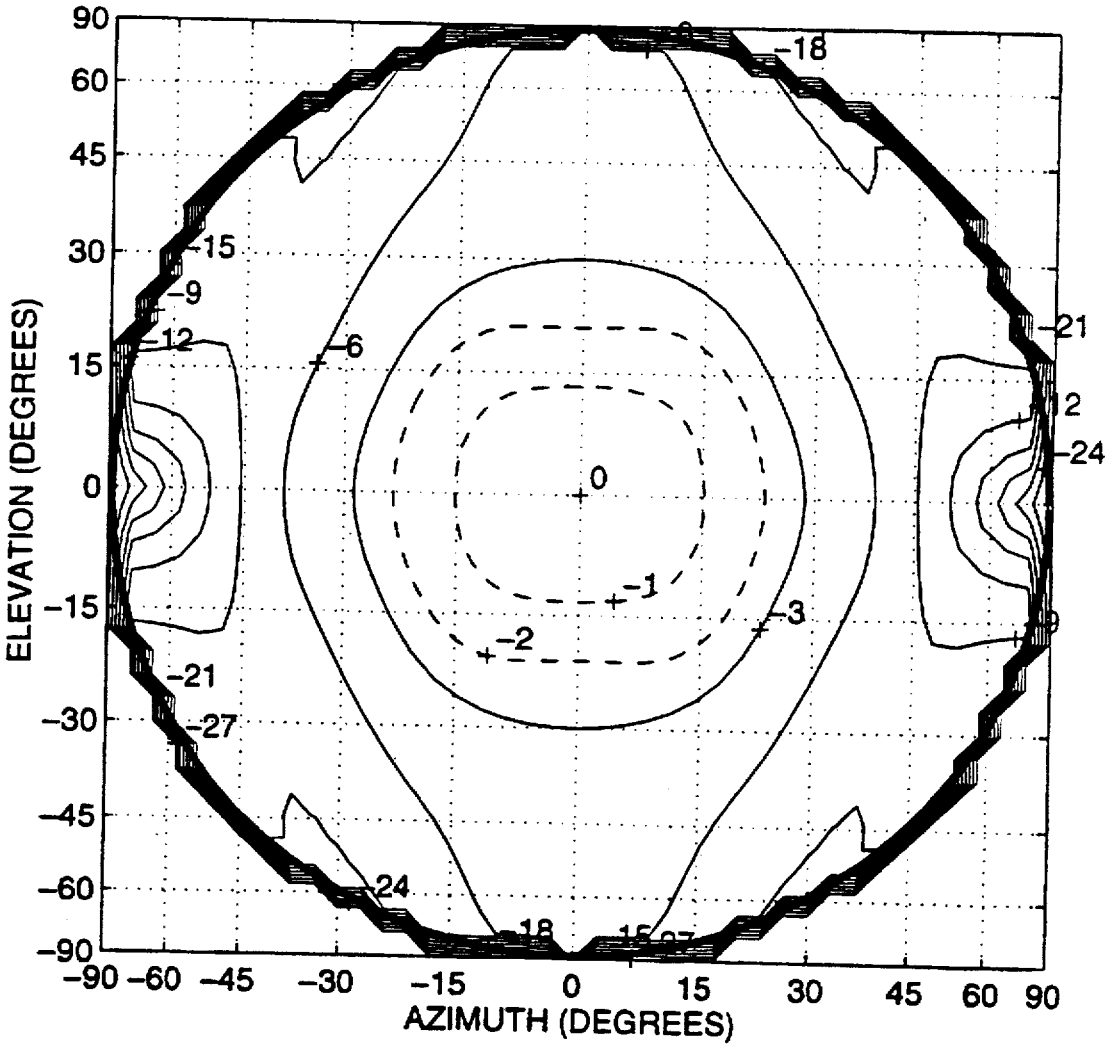

FIG. 13A shows the 3-dimensional directivity pattern in the frequency band 209–277 Hz for this array system. This pattern shows the average sensitivity of the system across all frequencies in the band as a function of the azimuth and elevation of the sound source. The beam is highly directive. Another way to visualize the directivity pattern is with polar contour plots. These are 2-dimensional drawings showing contours of constant sensitivity as a function of the azimuth and elevation. The look direction is perpendicular to the plane of the drawings. The acoustic center of the array is indicated by the crosses in the middle of the patterns. The contour plot for the frequency range 209–277 Hz is shown in FIG. 13B. This plot corresponds to the 3-dimensional plot of FIG. 13A. The dashed contours have 1 dB spacing, while the solid ones have 3 dB spacing. The beam width of the −3 dB contour is approximately ±32° in both azimuth and elevation. The contour plot for the frequency range 853–1129 Hz is shown in FIG. 13C. The 3 dB beam width is ±30° in both azimuth and elevation. FIG. 13D shows the contour plot for the frequency band 1982–2626 Hz. The 3 dB beam width is also ±30° in both azimuth and elevation. FIG. 13E shows the contour plot for the frequency band 4608–6104 Hz. The 3 dB beam width is ±29° in azimuth and ±30° in elevation.

The planar Lehr-Widrow array of FIG. 12 extends over 8.5"×5.5". These dimensions were selected as a compromise between the acoustically-ideal $\sqrt{2}$ ratio from Equation (14), and the dimensions that best fit the human torso. In the example geometry, there is also no microphone exactly at the center. At low frequencies, several of the microphones near the center combine to serve the purpose of the single central microphone used in the theoretical development of the planar Lehr-Widrow geometry. Replacing the central microphone with several microphones in this manner makes the array easier to place over the head when a neckloop is attached, and also reduces the system's sensitivity to variations in microphone gain.

The array is shown to produce directivity in both azimuth and elevation. The beam width is close to ±30° in azimuth and elevation over a very wide range of frequencies, from 209–6104 Hz. To achieve this beam width at the higher frequencies with an 8.5"×5.5" array is not unusual. Many different array types could do this. To achieve uniform beam width across frequency, and in particular, to achieve this narrow beam width in the lowest band (209–277 Hz), on the other hand, is very unusual. The wavelength at the center of this band is 56.1". An array designed in accord with the Widrow-Brearley patent would be a half wavelength or 28" wide. This could not be worn on the human torso. From antenna theory, it is well known that a simple additive array producing a ±30° beam width would require a width of approximately one wavelength or 56.1". This is not a practical width for a body-worn array.

Antenna theory had its beginnings in the late 19th century with the works of Lord Rayleigh, who discovered the fundamental relation between beam width and array size while working in the field of optics. His work is described in Bracewell, "The Fourier Transform and its Applications," McGraw-Hill, second edition, revised, 1986. According to Lord Rayleigh, the beam width in radians is equal to the reciprocal of the array size in wavelengths. A beam width of one radian (57.3°) would result from an array width of one wavelength. Lord Rayleigh assumptions were based on all-positive weighting. The Lehr-Widrow array can have a similar beam width but achieve it with a much smaller array. Lehr-Widrow can realize 60° beam width with an array of one tenth of a wavelength or less. This is accomplished by positively weighting the outer microphone signals, and negatively weighting the central microphone signals, a method not anticipated by Lord Rayleigh or the antenna theorists who followed him.

Other microphone types could realize 3-dimensional directivity patterns with ±30° beam widths. A microphone with a parabolic reflector could be designed to do this, and a "shotgun" microphone could be designed to do this. Both of these, however, are not flat and could not be worn conveniently on the body. Cardioid, supercardioid, and bidirectional gradient microphones of first or higher order could be used, but they are less robust than the Lehr-Widrow array in boundary microphone applications, their beam patterns have wider beam widths than the ±30° patterns that can be achieved by the Lehr-Widrow array, and commercially available microphones of this class typically offer very poor directivity at low frequencies. Except for the Lehr-Widrow array, no other microphone or microphone array that can be worn on the body or under clothing can achieve a ±30° beam width at low frequencies, below 500 Hz, and also at higher frequencies.

The Lehr-Widrow array is described here as a component of an assistive device for hearing aids. Its output signal could be fed to the ear magnetically by neck loop and telecoil in the hearing aid, or by an earphone. Other methods of telemetry could be used, such as high-frequency electromagnetic coupling, and infrared electromagnetic coupling, ultrasonic acoustic coupling.

The principles incorporated in the Lehr-Widrow array are such that this array design could be used not only for hearing aids, but with appropriate receiving elements, it could also be used for reception of high-frequency radio waves and radar waves, and for acoustic waves of all frequencies, including those used in sonar and seismic applications.

In order to develop an array which is attractive, comfortable, and easily concealed, the array geometry may be bent to conform to the wearer's body. When this is done, the microphones no longer lie exactly in a plane. This has some effect on the optimal microphone weightings, and the steepest-descent weight optimization process is able to account for this change. To improve performance, however, delays may be added to some of the microphones so that all microphone signals are in-phase when the source is in the look direction. These delays may also be used to "steer" the beam downward to counteract some of the upward slope of the wearer's chest. In the physical device, the delays can be incorporated acoustically or electronically. Straightforward modifications to the optimization procedure allow the microphone weightings to be optimized when delays are added to some of the microphone signals. To accomplish this, it is necessary only to recompute the phase delay of Equation (23). If s denotes the speed of sound, and $d_i$ denotes the time delay to microphone i, then Equation (23) becomes:

$$\phi_i = \frac{2\pi(\rho_i - d_i s v)^T v}{\lambda} . \tag{38}$$

Note that Equations (23) and (38) are identical when the delay $d_i$ is equal to zero. Note further that the use of delays to compensate for array curvature applies to all array configurations, such as V-shape, square shape, circular shape, etc.

To develop a practical device, another simple extension may be added to the optimization process to guarantee robustness to variations in the gain levels of "off-the-shelf"

microphones, to reduce sensitivity to the effects of microphone occlusion and reflections from the wearer's body, and to reduce array sensitivity to wind noise. During the optimization procedure, the sensitivity of each microphone i is no longer assumed to be fixed at unity. Instead the sensitivity is treated as the value $1+n_i$ where $n_i$ is a zero-mean random variable that changes during each update of the vector of microphone weights, W. The variance level of the random variable would generally range between 3–15%, but would depend on the characteristics of the particular microphones used in the physical implementation, and on the degree to which the microphone's position is subject to occlusion. This change causes the values of S and C from Equations (26) to become random vectors, rather than fixed functions of the direction of arrival of the incident sound. The converged solution yields a set of weights giving a directivity pattern that is somewhat less sharp, particularly at low frequencies, but the pattern is less sensitive to microphone imperfections and the array response is less sensitive to wind noise during outdoor use. Adding random noise to the microphone sensitivities during the optimization process causes a constraining of the weight magnitudes. Although the sharpness of the beam pattern is diminished, the loss is often acceptable because the main difficulties encountered outdoors are usually related to the effects of wind noise. The problems with directional noise and reverberation are generally less severe in the outdoor environment.

Presently-available integrated circuit technology makes it possible to develop low-cost Lehr-Widrow planar or quasi-planar hearing systems which have very low power requirements. Using high density circuit technology, complex array systems can be designed to fit within very compact enclosures. An array system may have several sets of microphone weighting values for each band so that the wearer may operate a switch to select different array directivity patterns for different circumstances. The set of array patterns may be designed by optimizing the sets of microphone weights using several different desired array power directivity patterns, $D(\theta_A,\theta_E)$ The array system may also allow selection from one or more sets of microphone weighting values designed specifically to have low sensitivity to wind noise so that a pattern with high directivity may be selected for use indoors, while a pattern with low sensitivity to wind noise may be selected for use outdoors.

The hearing system may also allow the wearer to select from several different frequency response curves. These curves may be preset at the factory, or they may be set by a professional hearing aid dispenser, or by the wearer.

The microphones in the Lehr-Widrow array may be either directional or omni-directional. Directional elements, such as cardioid microphones, supercardioid microphones, or bidirectional gradient microphones, can be used to obtain sharper directivity from the array system by placing the direction of maximum microphone sensitivity in the look direction of the array. A Lehr-Widrow array using cardioid microphones will have a small back lobe even in free space, so that it will perform well as a unidirectional microphone array even when it is not placed against a boundary such as the chest of a wearer. This configuration would be useful for improving the signal-to-noise ratio of signals received by computer speech recognition systems.

Because it has linear transfer characteristics, the Lehr-Widrow concept can be used in reverse to make directional transmitting arrays. This is a result of reciprocity theory, as described in Kraus, "Antennas," McGraw-Hill, 1950. To convert a directional receiving array into a directional transmitting array, all receiving elements, such as microphones, are replaced with transmitting elements, such as loudspeakers. All signal paths are reversed, all summing junctions are replaced by common points, and all common points are replaced by summing junctions. The Lehr-Widrow array of FIG. 11 configured now as a wideband directional acoustic transmitting array is shown in FIG. 14. The input signal 400 feeds common point 401 to apply identical inputs to the five gains 402–406 for the five individual bandpass filters 407–411. The output of each bandpass filter is weighted and applied to summers 421–424 which provide the driving signals for the four loudspeakers, 425–428.

A Lehr-Widrow array can also be constructed for use as a wideband directional transceiver by combining a directional transmitter and a directional receiver. If the receiving elements of the system, such as dynamic microphones, also behave as satisfactory transmitting elements, such as loudspeakers, then the same physical elements may be used at different times for transmitting and for receiving. The major circuit components, such as the bandpass filters, may be switched to operate in both the receiver and the transmitter, or the transmitter and the receiver may use separate circuit components.

The above description is based on preferred embodiments of the present invention; however, it will be apparent that modifications and variations thereof could be effected by one with skill in the art without departing from the spirit or scope of the invention, which is to be determined by the following claims.

What is claimed:

1. A directional acoustic receiving system comprising a housing supported on the chest of a user, an array of three or more microphones arranged in a V-shaped pattern mounted on the housing and directed away from the user's chest, each providing an output signal representative of received sound, signal processing electronics mounted on said housing for receiving and combining the microphone signals in such a manner as to provide an output signal which emphasizes sounds of interest arriving in a direction forward of the user, and means for amplifying said output signal, said output signal coupled by wire to an earphone or earphones in the ear of the user, or coupled by wireless telemetry based on ultrasound, infrared, radio frequency radiation, or magnetic coupling.

2. A directional acoustic receiving system comprising a housing curved to fit the torso and supported on the chest of a user by a conducting loop encircling the user's neck, an array of three or more microphones mounted and positioned to conform to the curved housing and directed away from the user's chest, said three or more microphones not an mounted along a single straight line, each of said microphones providing an output signal representative of received sound, signal processing electronics mounted on said housing for receiving ad combining the microphone signals in such a manner as to provide an output signal which emphasizes sounds of interest arriving in a direction forward of the user, means for amplifying said output signal and applying it to the conductive neck loop to provide a magnetic field which is representative of said output signal, and electroacoustic transducer means including a magnetic field pick up coil for receiving said magnetic field and generating an acoustic signal representative of said sounds of interest.

3. The directional acoustic receiving system of claim 2 wherein said array comprises microphones directed substantially perpendicular to the direction of arrival of said sounds of interest, yielding a system that is directive both in azimuth and elevation.

4. The directional acoustic receiving system of claim 3 wherein said microphones of said array are arranged in a V-shaped pattern.

5. The directional acoustic receiving system of claim 2 wherein said microphones of said array are arranged in a square pattern or a circular pattern.

6. The directional acoustic receiving system of claim 2 wherein said signal processing electronics implement the array whose microphone signal weights are determined by an automatic optimization process to provide a given sensitivity in the look direction and a best fit to a desired directivity pattern in other directions, thereby combining said microphone signals to produce said array's processed output signal.

7. The directional acoustic receiving system of claim 2 wherein the output signals of said microphones are delayed to compensate for the signal delays introduced by the curvature of said array to acoustic waves arriving from the direction of interest.

8. The directional acoustic receiving system of claim 3 wherein the output signals of said microphones are delayed to raise or to lower the elevation of the direction of interest of said array.

9. The directional acoustic receiving system of claim 2 wherein the output signals of said microphones are delayed to raise or to lower the elevation of the direction of interest of the array.

10. The directional acoustic receiving system of claim 2 wherein said microphones of said array are arranged in a V-shaped pattern or in a circular pattern, or in a square pattern.

11. The directional acoustic receiving system of claim 2 wherein said signal processing electronics uniformly weights and sums all of said microphone signals to provide said array's processed output signal.

12. The directional acoustic receiving system of claim 2 wherein said signal processing electronics implement the array whose microphone signal weights are determined by a solution of simultaneous equations to provide a given sensitivity in the look direction and zero sensitivity in directions perpendicular to the look direction, thereby combining said microphone signals to produce said array's processed output signal.

13. The directional acoustic receiving system of claim 2 wherein said signal processing electronics implement the array whose microphone signal weights are determined by an automatic optimization process to provide a given sensitivity in the look direction and a best fit to a desired directivity pattern in other directions, thereby combining said microphone signals to produce said array's processed output signal.

14. The directional acoustic receiving system of claim 3 wherein said signal processing electronics uniformly weights and sums all of said microphone signals to provide said array's processed output signal.

15. The directional acoustic receiving system of claim 3 wherein said signal processing electronics implements the array whose microphone signal weights are determined by a solution of simultaneous equations to provide a given sensitivity in the look direction and zero sensitivity in directions perpendicular to the look direction, thereby combining said microphone signals to produce said array's processed output signal.

16. The directional receiving system of claim 3 wherein said signal processing electronics implements the array whose microphone signal weights are determined by an automatic optimization process to provide a given sensitivity in the look direction and a best fit to a desired directivity pattern in other directions, thereby combining said microphone signals to produce said array's processed output signal.

17. The directional acoustic receiving system of claim 2 wherein said signal processing electronics implement the array whose microphone signal weights are determined by a solution of simultaneous equations to provide a given sensitivity in the look direction and zero sensitivity in directions perpendicular to the look direction, thereby combining said microphone signals to produce said array's processed output signal.

18. A directional transmitting array wherein the transmitting elements are arranged in a plane and excited by the output of a signal processor, said signal processor multiplying the input signal with a variable gain used to control frequency response, band-pass filtering, and then multiplying by a vector of weights, each weighted band-passed signal added to the input of a different transmitting element, said signal processor multiplying said input signal again by another variable gain used to control frequency response, band-pass filtering in a different but contiguous frequency band, multiplying by another vector of weights, each weighted band-passed signal again added to the input of a different transmitting element, and so forth until the various contiguous frequency bands cover the full range of frequencies of interest, the values of each vector of weights chosen for the center of the associated band-filter by finding the best possible solution in some sense such as the least mean square sense or the least mean fourth sense to simultaneous equations of the form $$D(\theta_A,\theta_E)-P(\theta_A,\theta_E,W)=0,$$

under the constraint that $$[1\ 1\ \ldots\ 1]W=1$$

where W is a column vector whose components are said vector of weights, where [1 1 . . . 1] is a row vector containing a number of components equal to the number of weights in W, where $D(\theta_A,\theta_E)$ is the desired magnitude of the transmitting array's radiation pattern at said center frequency as a function of azimuth and elevation angles $\theta_A$ and $\theta_E$, measured relative to a line perpendicular to the plane of the array, and where $P(\theta_A,\theta_E,W)$ is the actual array radiation pattern at said center frequency as a function of $\theta_A$, $\theta_E$, and W, constraining the array to have a given radiation pattern magnitude in the look direction perpendicular to the plane of said array, to have radiation pattern magnitude of approximately zero in directions perpendicular to the look direction, and to have radiation pattern magnitudes at other specified angles of arrival that approximate desired radiation magnitudes, said simultaneous equations being solved either analytically or by automatic optimization means, providing a radiation pattern that has an almost uniform beam width over a range of frequencies whose corresponding wavelengths may vary from very short compared to the width and height of the array to 10 times the width or height of the array.

19. A directional receiving array of receiving elements wherein the receiving elements are arranged in a plane, all receiving element output signals are weighted, summed, and band-pass filtered in a first frequency band, said receiving element output signals are weighted once again with a different set of weights, summed, and band-pass filtered in a different but contiguous frequency band, and so forth until the various contiguous frequency bands cover the full range of frequencies of interest, the values of each set of weights chosen for the center frequency of the associated band-pass filter by finding the best possible solution of simultaneous equations of the form $$D(\theta_A,\theta_E)-P(\theta_A,\theta_E,W)=0$$

under the constraint that $$[1\ 1\ \ldots\ 1]W=1$$

where W is a column vector whose components are said set of weights, where [1 1 . . . 1] is a row vector containing a number of components equal to the number of weights in W, where $D(\theta_A,\theta_E)$ is the desired sensitivity of the array's directivity pattern at said center frequency as a function of azimuth and elevation angles $\theta_A$ and $\theta_E$, measured relative to a line perpendicular to the plane of the array, and where $P(\theta_A,\theta_E,W)$ is the actual array sensitivity at said center frequency as a function of $\theta_A$,$\theta_E$, and W, the outputs of the band-pass filters weighted by variable gains to allow control of the frequency response of the receiving array, the weighted outputs of said band-pass filters summed to form the array output signal, constraining the array to have a given sensitivity in the look direction perpendicular to the plane of said array, to have a sensitivity of approximately zero in directions perpendicular to the look direction, and to have sensitivities at other specified angles of arrival that approximate desired sensitivities to provide a directivity pattern that has an almost uniform beam width over a practical range of frequencies whose corresponding wavelengths may vary from very short compared to the width and height of the array to 10 times the width or height of the array.

20. The directional receiving array of the type of claim 19 wherein said receiving elements are microphones and the receiving array is a directional acoustic receiving array.

21. The directional receiving array of microphones of claim 20 wherein said microphones are directional microphones such as cardioid microphones, supercardioid microphones, or bidirectional gradient microphones, said microphones oriented so that direction of maximum microphone sensitivity coincides with the look direction of the array.

22. The directional acoustic receiving array of microphones of claim 20 wherein receiving microphones are placed in a V-shaped pattern having width approximately $\sqrt{2}$ times the height, and having one or more receiving microphones located near the position that is centered vertically and horizontally.

23. The directional acoustic receiving array of microphones of claim 20 wherein receiving microphones are arranged along a horizontal line yielding a receiving array that is directive in azimuth and not in elevation.

24. The directional acoustic receiving array of microphones of claim 20 wherein receiving microphones are mounted on a support structure close to the chest or head of a user, or close to a wall, or table, or some other baffle-like structure that leaves the forward lobe of the directivity pattern unimpaired, but eliminates the back lobe by shadowing or by baffling.

25. The directional acoustic receiving array of microphones of claim 20 wherein said variable gains that control the frequency response have values that are stored in digital memory, the contents of the memory being changeable by internal means or by coupled external digital apparatus such as the serial port of a computer.

26. The directional acoustic receiving array of microphones of claim 20 wherein said variable gains that control the frequency response have values that are partially determined by power levels at the outputs of the corresponding band-pass filters, said power levels being measured by signal rectification or square law detection followed by moving average filtering, so that higher power sensed at the output of the individual band-pass filter causes a reduction of the corresponding gain value, with the final gain value determined by a combination of the power level and an external adjustment.

27. The directional acoustic receiving array of microphones of claim 20 wherein the output signals of said microphones are delayed to raise or to lower the elevation of the look direction of the array, its direction of maximum sensitivity.

28. A directional acoustic receiving array of microphones wherein the receiving microphones are arranged in a slightly warped plane, the microphone output signals are delayed to compensate for the signal delays introduced by the curvature of the array to acoustic waves arriving in the look direction, the delayed microphone signals are weighted, summed, and band-pass filtered, said delayed microphone output signals are weighted once again with a different set of weights, summed, and band-pass filtered in a different but contiguous frequency band, and so forth until the various contiguous frequency bands cover the full range of frequencies of interest, the values of each set of weights chosen for the center frequency of the associated band-pass filter by finding the best possible solution in some sense such as the least mean squares sense or the least mean fourth sense to simultaneous equations of the form $$D(\theta_A,\theta_E)-P(\theta_A,\theta_E,W)=0$$

under the constraint that $$(C^TW)^2+(S^TW)^2=1,$$

where W is a column vector whose components are said set of weights, where C is the corresponding column vector of the cosines of the phase delays to the individual microphones for a given sound source at said center frequency in the look direction, where S is the corresponding column vector of the sines of the phase delays to the individual microphones for said given sound source, where $D(\theta_A,\theta_E)$ is the desired sensitivity of the array's directivity pattern at said center frequency as a function of azimuth and elevation angles $\theta_A$ and $\theta_E$, measured relative to the look direction of the array, and where $P(\theta_O,\theta_E,W)$ is the actual array sensitivity at said center frequency as a function of $\theta_A$, $\theta_E$, and W, the outputs of the band-pass filters weighted by variable gains to allow control of the frequency response of the receiving array, the weighted outputs of said band-pass filters summed to form the array output signal, constraining the array to have a given sensitivity in the look direction, to have a sensitivity of approximately zero in directions perpendicular to the look direction, and to have sensitivities at other specified angles of arrival that approximate desired sensitivities, said simultaneous equations being solved either analytically or by automatic optimization means, providing a directivity pattern that has an almost uniform beam width over a practical range of frequencies whose corresponding wavelengths may vary from very short compared to the width and height of the array to 10 times the width or height of the array.

29. The directional acoustic receiving array of microphones of claim 20 wherein said automatic optimization means is enhanced by adding random independent noise to the individual microphone sensitivity values causing $P(\theta_A,\theta_E,W)$ to have a random component for each computation cycle, resulting in somewhat modified weight values that tend to have smaller magnitude differences, making the beam pattern less sharp but making said beam pattern less sensitive to natural variations in microphone sensitivity, and making the receiving array less sensitive to wind noise when used outdoors.

30. The directional acoustic receiving array of microphones of claim 28 wherein said automatic optimization means is enhanced by adding random independent noise to the individual microphone sensitivity values causing $P(\theta_A, \theta_E, W)$ to have a random component for each computation cycle, resulting in somewhat modified weight values that tend to have smaller magnitude differences, making the beam pattern less sharp but making said beam pattern less sensitive to natural variations in microphone sensitivity, and making the receiving array less sensitive to wind noise when used outdoors.

31. The directional acoustic receiving array of microphones of claim 28 wherein the values of the weights that feed said band-pass filters and control the shape of the beam pattern are able to be altered by a user controlled switch so that the width of the beam pattern can be selected by the user.

32. The directional acoustic receiving array of microphones of claim 28 wherein the values of the gains that are fed by said band-pass filters and that control the shape of the frequency response of the array are able to be altered by a user controlled switch so that the frequency response can be selected by the user.

33. The directional acoustic receiving array of microphones of claim 28 wherein said receiving array is worn on a user's chest and configured as a necklace comprising an array of three or more microphones mounted on a housing containing signal processing electronics designed to combine the microphone signals to emphasize sounds of interest arriving in the look direction forward of the user, a power source, and controls that may include on/off, volume, frequency response, and controls for other functions such as variabl e beam width, supported by a conducting loop around the user's neck that carries a current producing a magnetic field which is representative of said arrays processed output signal, said magnetic field providing inductive coupling to the telecoils of one or two hearing aids, thereby establishing a wireless connection between the directional signal of said array and the amplifiers of said hearing aids, said hearing aids delivering amplified directive sound to the ear or ears of the user.

34. The directional acoustic receiving array of microphones of claim 20 wherein said receiving array is worn on a user's chest and configured as a necklace comprising an array of two or more microphones mounted on a housing containing signal processing electronics designed to combine the microphone signals to emphasize sounds of interest arriving in the look direction forward of the user, supported by a conducting loop around the user's neck that carries a current producing a magnetic field which is representative of said array's processed output signal, said magnetic field providing inductive coupling to the telecoils of one or two hearing aids, thereby establishing a wireless connection between the directional signal of said array and the amplifiers of said hearing aids, said hearing aids delivering amplified directive sound to the ear or ears of the user.

35. The directional acoustic receiving array of microphones of claim 28 wherein said receiving array is mounted on a housing worn on the chest or on the head with the array output signal coupled by wire to an earphone or earphones in the ear of the user, or coupled by wireless telemetry based on ultrasound, infrared, radio frequency radiation, or magnetic coupling.

36. The directional receiving array of claim 19 wherein said array is designed and equipped to receive radio-frequency electromagnetic waves, radar waves, sonar waves, seismic waves, or ultrasonic acoustic waves.

37. The directional acoustic receiving array of microphones of claim 28 wherein receiving microphones are placed in a substantially V-shaped pattern having width approximately $\sqrt{2}$ times the height, and having one or more receiving microphones located near the position that is centered vertically and horizontally, with suitable choice of said desired sensitivity $D(\theta_A, \theta_E)$, obtaining a beam width that is sharper in azimuth and elevation than would be obtained from array theory based on the formula of Lord Raleigh.

38. The directional transmitting array of claim 18 wherein said array is designed and equipped to transmit audio-frequency acoustic waves, radio-frequency electromagnetic waves, radar waves, sonar waves, seismic waves, or ultrasonic acoustic waves.

39. The directional transceiver comprising the directional transmitting array of claim 18 combined with the directional receiving array of claim 19.

* * * * *